United States Patent [19]

Levasseur

[11] Patent Number: 4,763,769

[45] Date of Patent: Aug. 16, 1988

[54] COIN ACCEPTANCE MEANS AND METHOD

[75] Inventor: Joseph L. Levasseur, Chesterfield, Mo.

[73] Assignee: Coin Acceptors, Inc., St. Louis, Mo.

[21] Appl. No.: 914,876

[22] Filed: Oct. 3, 1986

[51] Int. Cl.[4] ..... G07F 5/16; G07F 5/24

[52] U.S. Cl. ..... 194/217; 453/17

[58] Field of Search ..... 194/217, 218, 216; 453/2, 17

[56] References Cited

U.S. PATENT DOCUMENTS

| | | | |
|---|---|---|---|
| 4,462,512 | 7/1984 | Schuller | 194/217 |
| 4,499,982 | 2/1985 | Sugimoto et al. | 194/217 |
| 4,499,985 | 2/1985 | Schuller | 194/218 X |

*Primary Examiner*—F. J. Bartuska

*Attorney, Agent, or Firm*—Haverstock, Garrett & Roberts

[57] ABSTRACT

A coin acceptance construction and method for use with a predefined price vending system which includes coin analysis apparatus capable of producing coin analysis data for determining coin validity, a controllable mechanism operable to effect the acceptance or return of deposited coins, coin availability status monitors for determining coins available for payback, such monitors producing coin availability status data indicative of the status of coins available for payback, and vend control circuitry for controlling a vend operation, which vend control circuitry is operable to accumulate credit and to effect a vend when the amount of accumulated credit at least equals the vend price. The coin acceptance construction, which may be either separate from the vend control circuitry, e.g., separate decoding circuitry, or form a part of the vend control circuitry, e.g., a programmed microprocessor, is responsive to the production by the coin analysis apparatus, upon detection thereby of a deposited coin, of coin analysis data representative of a valid coin to determine the acceptability of such validated deposited coin for the particular vend operation in progress, which determination is dependent upon the vend price, the accumulated credit, the coin analysis data representative of the validated deposited coin, and the coin availability status data. The coin acceptance construction operates to effect acceptance of such validated deposited coin by the controllable mechanism and the accumulation by the vend control circuitry of additional credit corresponding to the value of such validated deposited coin unless such additional credit accumulation would result in an overdeposit the correct amount of which is unavailable in coins available for payback.

24 Claims, 10 Drawing Sheets

Coin Tube Status

Coin Unacceptability If Vend Price Minus Accumulation Equals;

| Q (4) | D (9) | N (5) | .05 | .10 | .15 | .20 | .25 | .30 | .35 | .40 | .45 | .50 | .55 | .60 | .65 | .70 | .75 | .80 | .85 | .90 | .95 | ≥1.00 |
|---|---|---|---|---|---|---|---|---|---|---|---|---|---|---|---|---|---|---|---|---|---|---|
| 1 | 1 | 1 | | | | | | | | | | | | | | | | | | | | |
| 0 | 1 | 1 | | | | | | | | | | | | | | | | | | | | |
| 1 | 0 | 1 | | | | | | | | | | | | | | | | | | | | |
| 0 | 0 | 1 | $ | $ | $ | $ | $ | $ | $ | $ | $ | $ | $ | $ | $ | $ | | | | | | |
| 1 | 0 | 0 | $ Q D | $ Q | $ Q | $ Q | | $ | $ | $ | $ | | $ | $ | $ | $ | | $ | $ | $ | $ | |
| 0 | 1 | 0 | $ D | Q | $ | Q | $ | | $ | | $ | | $ | | $ | | $ | | $ | | $ | |
| 1 | 1 | 0 | D | Q | | Q | | | | | | | | | | | | | $ | | $ | |
| 0 | 0 | 0 | $ Q D | $ Q | $ Q | $ Q | $ | $ | $ | $ | $ | $ | $ | $ | $ | $ | $ | $ | $ | $ | $ | |

Fig. 1

| QS | DS | NS | $^{0}0_{0}$ | $^{0}0_{1}$ | $^{0}1_{0}$ | $^{x}x_{0}$ | $^{1}0_{0}$ | $^{x}0_{0}$ | $^{1}1_{0}$ | $^{x}1_{0}$ |
|---|---|---|---|---|---|---|---|---|---|---|
| 0 | 0 | 0 | 1 | 0 | 0 | 1 | 0 | 1 | 0 | 0 |
| 0 | 0 | 1 | 0 | 1 | 0 | 0 | 0 | 0 | 0 | 0 |
| 0 | 1 | 0 | 0 | 0 | 1 | 1 | 0 | 0 | 0 | 1 |
| 0 | 1 | 1 | 0 | 0 | 0 | 0 | 0 | 0 | 0 | 0 |
| 1 | 0 | 0 | 0 | 0 | 0 | 1 | 1 | 1 | 0 | 0 |
| 1 | 0 | 1 | 0 | 0 | 0 | 0 | 0 | 0 | 0 | 0 |
| 1 | 1 | 0 | 0 | 0 | 0 | 1 | 0 | 0 | 1 | 1 |
| 1 | 1 | 1 | 0 | 0 | 0 | 0 | 0 | 0 | 0 | 0 |

| S5 | S4 | S3 | S2 | S1 | .05 | .10 | .20 | <.25 | .25 | .50 | ≥.75 | .75 | <1.00 | 0.X5 |
|---|---|---|---|---|---|---|---|---|---|---|---|---|---|---|
| 0 | 0 | 0 | 0 | 0 | 1 | 0 | 0 | 1 | 0 | 0 | 0 | 0 | 1 | 1 |
| 0 | 0 | 0 | 0 | 1 | 0 | 1 | 0 | 1 | 0 | 0 | 0 | 0 | 1 | 0 |
| 0 | 0 | 0 | 1 | 0 | 0 | 0 | 0 | 1 | 0 | 0 | 0 | 0 | 1 | 1 |
| 0 | 0 | 0 | 1 | 1 | 0 | 0 | 1 | 1 | 0 | 0 | 0 | 0 | 1 | 0 |
| 0 | 0 | 1 | 0 | 0 | 0 | 0 | 0 | 0 | 1 | 0 | 0 | 0 | 1 | 1 |
| 0 | 0 | 1 | 0 | 1 | 0 | 0 | 0 | 0 | 0 | 0 | 0 | 0 | 1 | 0 |
| 0 | 0 | 1 | 1 | 0 | 0 | 0 | 0 | 0 | 0 | 0 | 0 | 0 | 1 | 1 |
| 0 | 0 | 1 | 1 | 1 | 0 | 0 | 0 | 0 | 0 | 0 | 0 | 0 | 1 | 0 |
| 0 | 1 | 0 | 0 | 0 | 0 | 0 | 0 | 0 | 0 | 0 | 0 | 0 | 1 | 1 |
| 0 | 1 | 0 | 0 | 1 | 0 | 0 | 0 | 0 | 0 | 1 | 0 | 0 | 1 | 0 |
| 0 | 1 | 0 | 1 | 0 | 0 | 0 | 0 | 0 | 0 | 0 | 0 | 0 | 1 | 1 |
| 0 | 1 | 0 | 1 | 1 | 0 | 0 | 0 | 0 | 0 | 0 | 0 | 0 | 1 | 0 |
| 0 | 1 | 1 | 0 | 0 | 0 | 0 | 0 | 0 | 0 | 0 | 0 | 0 | 1 | 1 |
| 0 | 1 | 1 | 0 | 1 | 0 | 0 | 0 | 0 | 0 | 0 | 0 | 0 | 1 | 0 |
| 0 | 1 | 1 | 1 | 0 | 0 | 0 | 0 | 0 | 0 | 0 | 1 | 1 | 1 | 1 |
| 0 | 1 | 1 | 1 | 1 | 0 | 0 | 0 | 0 | 0 | 0 | 1 | 0 | 1 | 0 |
| 1 | 0 | 0 | 0 | 0 | 0 | 0 | 0 | 0 | 0 | 0 | 1 | 0 | 1 | 1 |
| 1 | 0 | 0 | 0 | 1 | 0 | 0 | 0 | 0 | 0 | 0 | 1 | 0 | 1 | 0 |
| 1 | 0 | 0 | 1 | 0 | 0 | 0 | 0 | 0 | 0 | 0 | 1 | 0 | 1 | 1 |
| 1 | 0 | 0 | 1 | 1 | 0 | 0 | 0 | 0 | 0 | 0 | 1 | 0 | 0 | 0 |
| 1 | 0 | 1 | 0 | 0 | 0 | 0 | 0 | 0 | 0 | 0 | 1 | 0 | 0 | 0 |
| 1 | 0 | 1 | 0 | 1 | 0 | 0 | 0 | 0 | 0 | 0 | 1 | 0 | 0 | 0 |
| 1 | 0 | 1 | 1 | 0 | 0 | 0 | 0 | 0 | 0 | 0 | 1 | 0 | 0 | 0 |
| 1 | 0 | 1 | 1 | 1 | 0 | 0 | 0 | 0 | 0 | 0 | 1 | 0 | 0 | 0 |
| 1 | 1 | 0 | 0 | 0 | 0 | 0 | 0 | 0 | 0 | 0 | 1 | 0 | 0 | 0 |
| 1 | 1 | 0 | 0 | 1 | 0 | 0 | 0 | 0 | 0 | 0 | 1 | 0 | 0 | 0 |
| 1 | 1 | 0 | 1 | 0 | 0 | 0 | 0 | 0 | 0 | 0 | 1 | 0 | 0 | 0 |
| 1 | 1 | 0 | 1 | 1 | 0 | 0 | 0 | 0 | 0 | 0 | 1 | 0 | 0 | 0 |
| 1 | 1 | 1 | 0 | 0 | 0 | 0 | 0 | 0 | 0 | 0 | 1 | 0 | 0 | 0 |
| 1 | 1 | 1 | 0 | 1 | 0 | 0 | 0 | 0 | 0 | 0 | 1 | 0 | 0 | 0 |
| 1 | 1 | 1 | 1 | 0 | 0 | 0 | 0 | 0 | 0 | 0 | 1 | 0 | 0 | 0 |
| 1 | 1 | 1 | 1 | 1 | 0 | 0 | 0 | 0 | 0 | 0 | 1 | 0 | 0 | 0 |

Fig. 6

| | S1 | S2 | S3 | S4 | S5 | $C_0$ |
|---|---|---|---|---|---|---|
| .05 | 0 | 0 | 0 | 0 | 0 | 1 |
| .10 | 1 | 0 | 0 | 0 | 0 | 1 |
| .15 | 0 | 1 | 0 | 0 | 0 | 1 |
| .20 | 1 | 1 | 0 | 0 | 0 | 1 |
| .25 | 0 | 0 | 1 | 0 | 0 | 1 |
| .30 | 1 | 0 | 1 | 0 | 0 | 1 |
| .35 | 0 | 1 | 1 | 0 | 0 | 1 |
| .40 | 1 | 1 | 1 | 0 | 0 | 1 |
| .45 | 0 | 0 | 0 | 1 | 0 | 1 |
| .50 | 1 | 0 | 0 | 1 | 0 | 1 |
| .55 | 0 | 1 | 0 | 1 | 0 | 1 |
| .60 | 1 | 1 | 0 | 1 | 0 | 1 |
| .65 | 0 | 0 | 1 | 1 | 0 | 1 |
| .70 | 1 | 0 | 1 | 1 | 0 | 1 |
| .75 | 0 | 1 | 1 | 1 | 0 | 1 |
| .80 | 1 | 1 | 1 | 1 | 0 | 1 |
| .85 | 0 | 0 | 0 | 0 | 1 | 1 |
| .90 | 1 | 0 | 0 | 0 | 1 | 1 |
| .95 | 0 | 1 | 0 | 0 | 1 | 1 |
| 1.00 | 1 | 1 | 0 | 0 | 1 | 1 |

COIN ACCEPTANCE MEANS AND METHOD

BACKGROUND OF THE INVENTION

The present invention relates to a coin acceptance means and method, and, more particularly, to a coin acceptance means for use in a vending system wherein a vend price is established prior to coin deposit or the submission of other credit means by a customer, for determining, based upon the ability of the system to provide a correct amount of change to the customer if a particular deposited coin or other credit submission is accepted, whether a given deposited coin or credit submission, even if valid, will be accepted.

It will be appreciated that, throughout this application, the term "coin" may be employed to mean any coin (whether valid or counterfeit), token, slug, washer, or other item, including currency and scrip, which might be used by an individual in an attempt to operate a coin-operated device or system. A "valid coin" is considered to be an authentic coin, token, or the like of the monetary system or systems in which or with which the coin-operated device or system is intended to operate and of a denomination which the device or system is intended selectively to receive and to treat as an item of value. A coin is considered to be "accepted" when it is determined to be a valid coin and a credit therefor is entered in the vending system.

Generally, single price vending systems have a pre-established vend price against which an accumulated credit is compared to determine whether a vend operation will be effected. Many multi-price vending systems, on the other hand, are so designed to permit the customer to deposit coins to build up an accumulated credit entry, which credit entry is compared against a vend price subsequently established when the customer actuates a vend selection means to select a particular product having a particular vend price. However, even some multi-price vending systems may be so designed that a vend price is established prior to any coin deposit or any recognition thereof. For example, a multi-price system may be so designed to require selection of the desired product prior to the recognition of any coin deposit. With such a system the vend price would be established by the product selection made, and the vending system would thereafter function in similar fashion to a single price vending system. The coin acceptance means of the present invention is primarily directed to single price vending systems and to multi-price vending systems wherein a vend price for a given vend operation is established prior to the deposit of coins or submission of credit with regard to such particular vend operation. For the sake of convenience, such systems will hereinafter be referred to as predefined price vending systems.

In the past, most predefined price vending systems have functioned in one of two different ways to try to ensure that a customer would receive the proper amount of change in the event that he had made an overdeposit. A number have been designed such that an exact change light is caused to be illuminated whenever the change making tube for the lowest denomination coin is found to be empty. With some of such vending systems, especially systems wherein the vend price is equal to the value of a particular denomination of coin, if the customer chooses to ignore the exact change light and to deposit a coin which does not constitute "exact change", the system will refuse to accept such coin and will simply return such deposited coin to the customer.

In such a way, such systems can ensure that no overdeposit will be accepted and that no payback will be required. With other "exact change" systems, if the customer chooses to ignore the exact change light and deposits a coin sufficient to result in an overdeposit situation, the system will function to accept the coin and to effect a vend of the product selected, and will also attempt to provide a refund in the proper amount, but with no guarantee that the correct amount, or, perhaps, any amount, will actually be refunded to the customer. Consequently, in such a situation, it is quite likely that the customer may receive less than the full refund amount to which he is really entitled.

Other vending systems have been so designed that they receive the deposited coin and total the credit entries, subtract the vend price from such credit total to obtain a refund amount due, and then determine if sufficient change remains available in the change making tubes to actually pay back to the customer the refund amount due. Such types of vending systems have generally allowed the customer to deposit coins prior to the making of any vend selection in order to accumulate a credit entry, and have permitted such customer to thereafter make a vend selection to establish a vend price. Such systems typically determine both whether the accumulated credit entry is sufficient in view of the vend price established and whether any refund amount will be due to the customer as a result of an overdeposit. If it is determined that the credit entry is at least equal to the vend price and that sufficient change remains to pay back any refund amount due, such systems have then collected the deposited coins, effected a vending of the selected product, and paid back the particular refund amount, if any, due. However, if they have determined that insufficient change remains to pay back the particular refund amount that would be due, all the deposited coins, or coins of like total value, have been returned to the customer and no product vend has been effected.

Representative of some of the various types of vending systems noted hereinabove and of controls therefor or coin changing features that could be employed therewith are those constructions disclosed in U.S. Pat. Nos. 4,188,961; 4,191,999; 4,462,512; 4,499,982; and 4,499,985.

With many of the known predefined price vending systems that include changemakers, a vend is not permitted if proper coins are not available for use in refunding the amount of an overdeposit. In such cases, the customer, who has typically deposited a plurality of coins to accumulate a credit entry, which coins are retained by the system upon deposit and the validation thereof, is refunded the total amount of his deposit, either automatically, as a function of the vending system, or upon actuation by him of an escrow switch. In any event, the entire deposited amount of credit is returned to the customer. If, by chance, such customer has available to him additional or other change in such an amount that he can deposit an exact change amount or some other amount for which the vend system includes appropriate change to allow a refund to be made, such customer may seek to obtain a vend by again commencing coin deposit, often re-depositing many of the same coins just returned to him. The noted return of all of such coins to the customer and the subsequent redeposit of a portion thereof by him in further efforts to obtain a vend may take a significant amount of time in terms of the ability of the vend system to vend products to customers. Such time factor may become problemsome if there are a number of people waiting to use the vend system and several of the people near the beginning of the line all initially make deposits for which the system cannot provide a correct refund. If even some of such customers, after a first refund of all deposited coins, seek to re-deposit coins to obtain a vend, the delay to customers farther back in line will be increased. If the delay becomes too long, the individuals farther back in line may grow irritated, and, in some instances, decide not to wait for their turn, as a consequence of which sales will be lost. Even those who are willing to wait for their turn may develop less positive attitudes toward the vend system and the products vended thereby, the long term effect of which may be a reduction in sales. It is therefore desirable that such delay time in vending, which delay time results from the return of all deposited coins when non-refundable overdeposits are detected and the re-deposit of a portion of such returned coins in a subsequent vend operation, be minimized or eliminated, and the present invention is directed to such end.

SUMMARY OF THE INVENTION

The present invention is directed to a coin acceptance means and method for use with a vending system wherein a vend price is established prior to coin deposit or the submission of other credit means by a customer, which vending system includes coin analysis means for analyzing deposited coins to establish the validity thereof, such coin analysis means operable to produce coin analysis data, controllable means operable to effect the acceptance or return of deposited coins, coin availability status monitor means for determining coins available for payback, such monitor means producing coin availability status data indicative of the status of coins available for payback, and vend control means for controlling a vend operation, which vend control means is operable to accumulate credit and to effect a vend when the amount of accumulated credit at least equals the vend price. The coin acceptance means, which may be either separate from the vend control means, e.g., separate decoding circuitry, or form a part of the vend control means, e.g., a programmed microprocessor, is responsive to the production by the coin analysis means, upon detection thereby of a deposited coin, of coin analysis data representative of a valid coin to determine the acceptability of such validated deposited coin for the particular vend operation in progress, which determination is dependent upon the vend price, the accumulated credit, the coin analysis data representative of the validated deposited coin, and the coin availability status data. The coin acceptance means operates to effect acceptance of such validated deposited coin by the controllable means and the accumulation by the vend control means of additional credit corresponding to the value of such validated deposited coin unless such additional credit accumulation would result in an overdeposit the correct amount of which is unavailable in coins available for payback.

Thus, in operation, when a deposited coin is validated, the preferred embodiments of the present invention determine with respect to each such validated coin whether or not such coin will actually be accepted. If the value of such validated coin is such that the credit amount thereof, when added to the credit previously accumulated, would result in an overdeposit condition, such coin will be accepted only if there are coins available for payback in an amount sufficient to permit the correct amount of the overdeposit to be returned to the customer. If the correct amount of overdeposit cannot be returned from the coins available for payback, the coin, even though valid and validated, will not be accepted, but, instead, will be returned to the customer. Consequently, vending systems that employ such preferred embodiments determine for each validated coin whether or not that particular validated coin will be accepted by the system based upon the ability of the system to be able to pay back to the customer the correct amount of any overdeposit that might be occasioned by the acceptance of such validated coin.

It will be appreciated that, with such coin acceptance means, it is not necessary or required that all deposited coins be returned to the customer when the last deposited valid coin would, if accepted, result in an overdeposit, the correct amount of which is unavailable for payback from among the coins available to be utilized for payback. Rather, only the "unacceptable" coin that was last deposited is returned. If the customer has available to him other coins of "acceptable" denomination, he can then deposit such other "acceptable" coins to obtain a vend without having to await the return of all his previously deposited coins and without having to re-initialize a vend operation by re-depositing coins. Such coin acceptance means is therefore effective in greatly reducing the vending delay time associated with overdeposit situations wherein the correct amount of the overdeposit cannot be returned from the coins available for payback.

In light thereof, it will be recognized that a principal object of the present invention is to provide a new and improved coin acceptance means for use with predefined price vending systems.

A further object of such invention is to teach the construction and operation in a predefined price vending system of a coin acceptance means that permits a determination of the acceptability of each validated deposited coin to be made prior to the acceptance of such coin based upon the ability of the vending system to be able to pay back to a customer the correct amount of any overdeposit that might be occasioned by the acceptance of such coin.

A still further object of the invention is to provide a coin acceptance means that can be employed with predefined price vending systems to ensure that a customer will be able to receive the correct amount of change for any overdeposit condition effected by his deposit of coins and the vending system's acceptance thereof.

Another object is to teach the construction and operation of a vending system that will not accept a coin, even a valid coin, unless the customer can be refunded the correct amount of any overdeposit that might be occasioned by the acceptance of such coin.

A further object is to provide a coin acceptance means that will prevent the acceptance of a validated coin if its value is such that an inadequate amount of change would be available for payback of an overdeposit that would result from the acceptance of such coin.

Still another object is to provide a coin acceptance means that reduces the vending delay time associated with overdeposit situations wherein the correct amount of the overdeposit is not refundable to the customer from the coins available for payback.

These and other objects and advantages of the present invention will become apparent to those skilled in the art after considering the following detailed specification in conjunction with the accompanying drawings, wherein:

BRIEF DESCRIPTION OF THE DRAWINGS

FIG. 1 is a table identifying correspondences between status conditions of coin tube monitor means and coin denomination unacceptability under various vend conditions.

FIG. 6 is a truth table for the decoding circuitry embodiment depicted in FIG. 5.

DETAILED DESCRIPTION OF PREFERRED EMBODIMENTS

Figure 2:
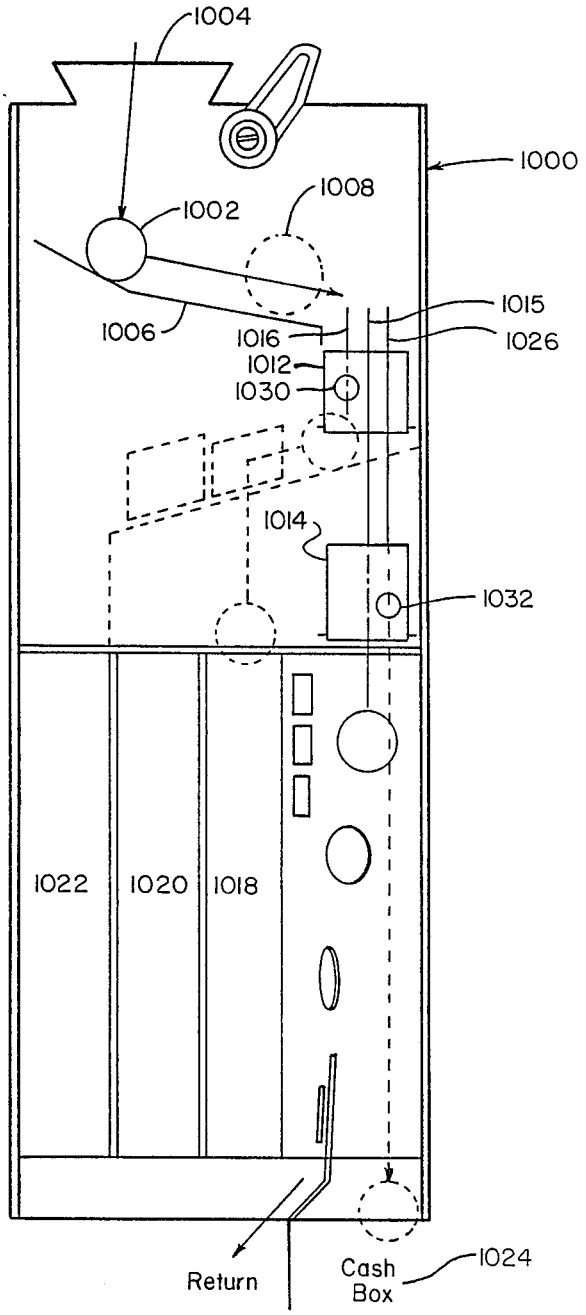
FIG. 2 is a diagrammatic depiction of a typical coin changer unit depicting in a simplified form various possible coin paths in and/or through such unit.

Referring now to the drawings, wherein like reference numbers refer to like items, FIG. 1 is a table that denotes, for a typical vending system capable of accepting nickels, dimes, quarters, and dollar coins, the particular coin denominations whose acceptance under certain vend conditions would result in overdeposit conditions wherein the correct amount of the overdeposit cannot be returned to the customer from the coins available for payback. Such table assumes a system having nickel, dime, and quarter coin payout tubes with monitor means therefor respectively set to detect minimum levels of four (4) quarters, nine (9) dimes, and five (5) nickels, wherein a 1 status signifies that at least such specified minimum number of coins is available in the coin payout tube and a 0 status signifies that less than such minimum level of coins is available in the coin payout tube. By way of illustration, a 111 status for such tubes signifies that at least four (4) quarters are available in the quarter payout coin tube, that at least nine (9) dimes are available in the dime payout coin tube, and that at least five (5) nickels are available in the nickel payout coin tube. Conversely, a 000 status signifies that less than four (4) quarters are available in the quarter payout coin tube, that less than nine (9) dimes are available in the dime payout coin tube, and that less than five (5) nickels are available in the nickel payout coin tube. For all practical purposes, a 0 status may be considered an indication that the tube is empty.

It will be understood that, as coins are deposited and accepted during any given vend operation, credit is accumulated in an amount corresponding to the total value of the accepted coins until such time as the accumulated credit equals or exceeds the vend price, at which time a vend is then authorized. At any given time prior to vend authorization there will therefore exist a difference between the vend price and the value of the accumulated credit, which difference may be readily expressed in increments corresponding in value to the value of the lowest denomination coin that can be accepted by the system. Any valid coin thereafter deposited which has a value less than or equal to the existing difference can be readily accepted since additional credit accumulation attributable to such coin would not cause the new accumulated credit total to exceed the vend price, as a consequence of which there is no need to be concerned with coin payback due to such deposits since no overdeposit condition can be occasioned by the acceptance of such coin. On the other hand, if a valid coin having a value greater than the existing difference is deposited, an overdeposit condition will arise if the coin is accepted, and coin payback will then be required. However, depending upon the status of the coin tube monitor means, it may not be possible to pay back the correct amount of overdeposit if such coin is accepted. Unless the acceptance of such coin would permit the correct amount of overdeposit to be paid back, it is therefore desirable not to accept such coin.

With regard to the table of FIG. 1, since the lowest valued coin assumed to be acceptable is a nickel, and since the highest valued coin assumed to be acceptable is a dollar coin, such table can be set up to indicate, for existing differences between a vend price and accumulated credit at the time of deposit of a valid coin, which differences are expressed in nickel increments ranging from a value of $.05 to a value of $.95, and for different status conditions of the coin payout tubes, those particular valid coins whose acceptance under the indicated conditions would result in an overdeposit the correct amount of which could not necessarily be able to be returned to the customer from the coins available for payback. By way of illustration, if the coin tube status at the time of a coin deposit is 111, 011, or 101, any valid coin can be accepted since, for any overdeposit condition possible, adequate coins in an appropriate amount will be available in the coin tubes for refund of the overdeposit.

However, if the coin tube status is 001, there may be as little as 25¢ (five (5) nickels) available for payback. Consequently, if the existing difference is less than $.75 and a valid dollar coin is deposited, payback of the correct amount of overdeposit may not be possible if the dollar coin is accepted. For example, if the existing difference is $.70 and a dollar coin is deposited, an overdeposit of 30¢ would arise if the dollar coin were accepted. Since only 25¢ in coins may be available for payback, however, the deposited dollar coin is therefore considered unacceptable under such circumstances, even though it is a valid coin.

Similarly, if the tube status is 100, there may be only four (4) quarters available for payback. Consequently, unless the existing difference is $.25, $.50, or $.75 at the time of a coin deposit, acceptance of a dollar coin would result in an overdeposit the correct amount of which may not necessarily be able to be refunded from the coins available for payback. For all other existing differences of less than $1.00 in the table, a dollar coin would therefore be considered unacceptable. Also, since with a tube status of 100 there may be no nickels and dimes availabe for payback, a quarter would be considered unacceptable for differences less than $.25 at the time of a coin deposit and a dime would be considered unacceptable for a difference of $.05 at the time of a coin deposit.

For a tube status of 010 there may be a total of only 90¢ (nine (9) dimes) available for payback, refundable only in dime (10¢) increments. Consequently, for existing differences of $.X5 in the table, i.e., differences of $.05, $.15, $.25, $.35, $.45, $.55, $.65, $.75, $.85, and $.95, a dollar coin would be considered unacceptable since the correct amount of overdeposit may not be able to paid back if the dollar coin were accepted. Also, for existing differences of $.10 and $.20, a quarter would not be considered acceptable since the acceptance thereof under such circumstances would result in respective overdeposits of 15¢ and 5¢, the correct amounts of which may not be able to be paid back from the coins available for payback. Furthermore, for an existing difference of $.05, a dime would not be considered acceptable since the acceptance thereof would result in an overdeposit of 5¢.

If the tube status is 110, at a minimum there are four (4) quarters and nine (9) dimes available for coin payback. A dollar coin would be considered unacceptable only for existing differences of $.85 and $.95. Under such circumstances the acceptance of a dollar coin would result in respective overdeposits of 15¢ and 5¢, which amounts cannot be realized through any refund combination of quarters and dimes. Likewise, a quarter would not be considered acceptable for existing differences of $.10 and $.20 since the acceptance thereof under such circumstances would result in respective overdeposits of 15¢ and 5¢, and a dime would not be considered acceptable for an existing difference of $.05 since the acceptance thereof would result in an overdeposit of 5¢.

For a tube status of 000, under which there may be no coins of any value available for coin payback, any coin the acceptance of which would result in an overdeposit is considered unacceptable. Consequently, a dollar coin is considered unacceptable for all existing differences of less than $1.00 in the table; a quarter is considered unacceptable for all existing differences less than $.25; and a dime is considered unacceptable for an existing difference less than $.10, i.e., a difference of $.05.

In the design of a coin acceptance means that can operate in such a way to determine for each deposited validated coin whether or not such coin will be accepted or returned, the designer must take into account the particular vending system and coin handling equipment with which the coin acceptance means is to be employed. Number 1000 in FIG. 2 refers to a coin changer unit of the type typically employed in many existing vending systems. Coins, such as coin 1002, may be deposited at coin inlet 1004, and they thereafter move along a coin path 1006, which path may include means of various types for mechanically sizing coins and separating certain kinds of slugs from among the coins deposited, to pass by and/or interact with a coin analysis or sensing means 1008 that is operable to produce coin analysis data pertinent to such coin. Numerous types of coin analysis means and coin sensing means are known to those skilled in the art, any number of which means might be equally and advantageously used in vending systems constructed to include the coin acceptance means of the present invention. Typical of some of such known coin analysis means and sensing means are constructions disclosed in U.S. Pat. Nos. 3,653,481; 3,739,895; 3,797,307; 3,797,628; 3,870,137; 3,918,563; 3,918,564; 3,918,565; 3,952,851; 3,966,034; 4,151,904; 4,254,857; 4,460,003; 4,509,633, and U.S. patent application Ser. No. 772,702.

Depending upon whether either of the controllably operable diverters or gates 1012 (Gate A) or 1014 (Gate B) are operated, the coin may thereafter be caused to follow one of several different possible paths. If neither of gates 1012 or 1014 are operated, the coin will follow path 1015 to be returned to the customer. If gate 1012 is operated, the coin will follow path 1016 and, depending upon its denomination, will be directed into dime coin tube 1018, nickel coin tube 1020, quarter coin tube 1022, or, if the appropriate coin tube is filled, will be caused to fall to the front or rear of the coin tubes or otherwise be directed into a coin collection or cash box 1024. If gate 1014 is operated instead of gate 1012, e.g., as in the case of a deposit of a validated and accepted dollar coin, the coin will follow path 1026 and be directed into coin collection box 1024. Sensing means, such as sensing means 1030 and sensing means 1032, may be positioned to detect movement of the deposited coin past or through an appropriate gate or along an appropriate path and to produce sensor signals indicative of such coin detection.

Figure 3:
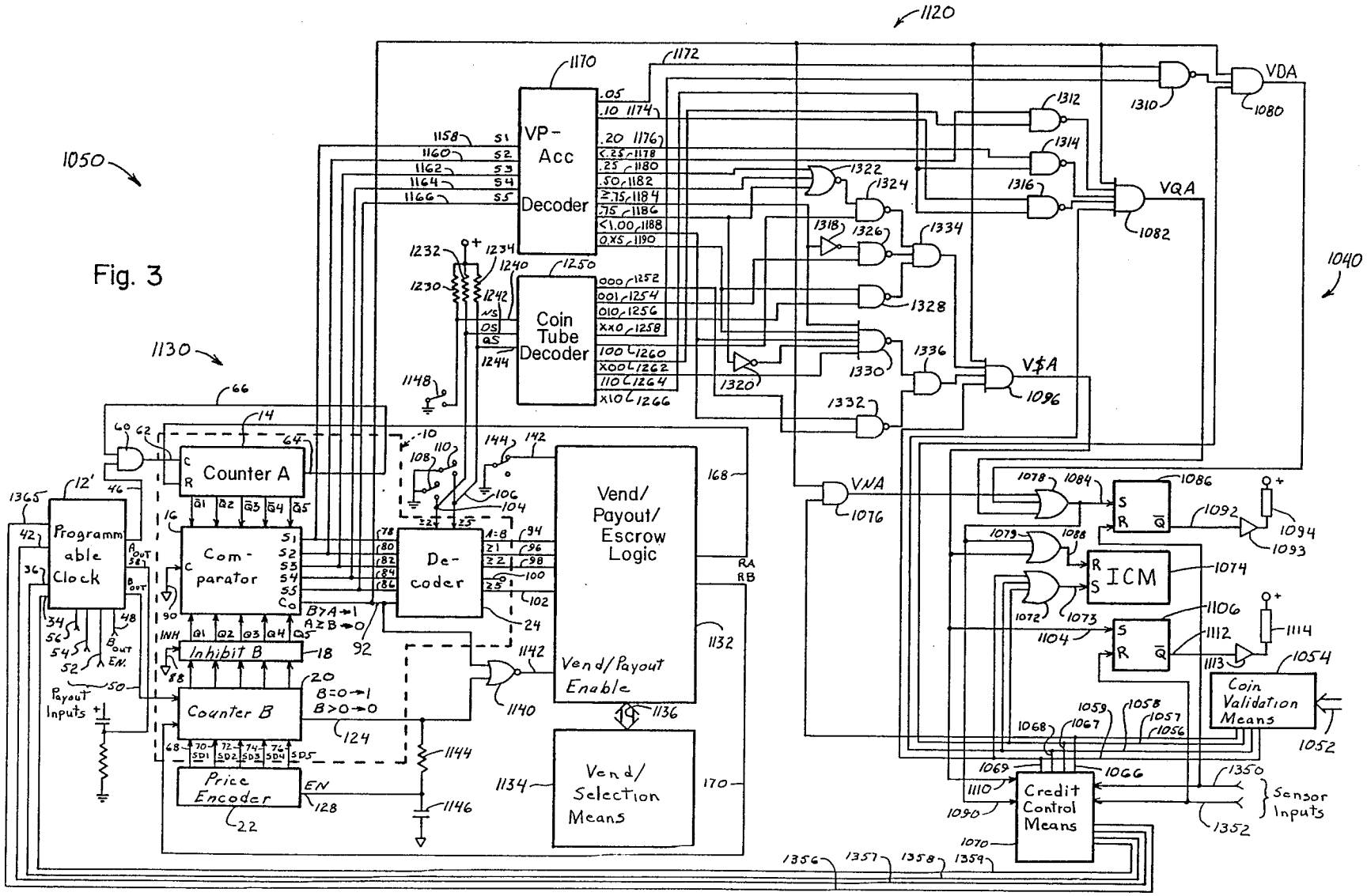
FIG. 3 is a schematic representation, partly in block form, of one particular embodiment of the present invention as employed in a particular vending system.

From the foregoing, it will be appreciated that the collection of any particular deposited coin in the changer unit 1000 depends upon whether either of the gates 1012 or 1014 are operated. Such gate operation can be made readily controllable by a coin acceptance means, such as the coin acceptance 1040 included within the vending system 1050 depicted in FIG. 3. Coin analysis data from the coin analysis means 1008 may be supplied via a data path 1052 to a coin validation means 1054, which validation means may take many forms. Typical of some of the coin validation means and techniques that could be employed are those disclosed in the patents previously noted hereinbefore. It will be appreciated that the particular form of the coin validation means employed in the vending system of FIG. 3 is of little pertinence, though, so long as such validation means is operable upon the deposit and analysis of a valid coin to produce coin validation data on the coin validation means output leads 1056–1059, which data is indicative of the value of the validated coin. In the vending system depicted in FIG. 3, the signals on leads 1056–1059 will remain LO unless and until a valid coin is detected. If a valid coin is detected, the signal on an appropriate one of the leads 1056–1059 will be caused to go HI for a sufficiently long enough time to permit certain gating operations, which will be discussed in more detail in that which follows, to be carried out. Thus, detection of a valid nickel will result in a HI signal on lead 1056, while detection of a valid dime will result in a HI signal on lead 1057, detection of a valid quarter will result in a HI signal on lead 1058, and detection of a valid dollar coin will result in a HI signal on lead 1059.

The coin validation means output leads 1056–1059 are connected as input leads 1066–1069 to credit control means 1070, and leads 1057–1059 are also connected as inputs to OR gate 1072. For ease of reference with respect to identification of the inputs and outputs of logic gates depicted in the drawings hereof and discussed herein, the output of any particular logic gate will be identified by the number referring to such gate and by the suffix designation ".o", signifying "output", and the inputs thereof will be identified by the number referring to such gate and by a suffix designation in the form ".i1", ".i2", and so forth, signifying "input, 1", "input 2", and so forth. The inputs for such logic gates will be numbered in a counterclockwise direction starting with the uppermost left input for the gate. In accordance with such numbering convention, it will be understood that leads 1057–1059 are connected, respectively, as inputs 1072.i1–1072.i3 of OR gate 1072, and that output 1072.o of OR gate 1072 is connected to the set S input 1073 of indication control means (ICM) 1074, the purpose and operation of which means will be explained further hereinafter.

Coin validation means output lead 1056 is also connected as an input 1076.i2 of AND gate 1076, the output 1076.o of which, designated the Validated Nickel Accept (VNA) output, is connected to the first input 1078.i1 of a 3-input OR gate 1078. In similar fashion, coin validation means output lead 1057 is also connected to an input 1080.i3 of AND gate 1080, the output 1080.o of which, designated the Validated Dime Accept (VDA) output, is connected to the second input 1078.i2 of OR gate 1078. Further, coin validation means ouput lead 1058 is also connected to an input 1082.i5 of AND gate 1082, the output 1082.o of which, designated the Validated Quarter Accept output (VQA), is connected to the third input 1078.i3 of OR gate 1078.

It will be appreciated by those skilled in the art that a HI signal will be produced on the output 1078.o of OR gate 1078 if any one of the gating conditions of AND gates 1076, 1080, and 1082 are satisfied, i.e., if a determination is made that a validated nickel, dime, or quarter may be accepted. In such event, the HI signal produced on the output 1078.o of gate 1078 would be provided to set S input 1084 of flip-flop 1086, to an input 1079.i1 of OR gate 1079, the output 1079.o of which is connected to the reset R input 1088 of ICM, and to input 1090 of credit control means 1070. Application of a HI signal to set S input 1084 of flip-flop 1086 will cause the $\overline{Q}$ output 1092 thereof to go LO, thereby energizing Gate A relay 1094, which is connected between a positive voltage source and output 1093.o of driver means 1093, the input 1093.i of which is connected to $\overline{Q}$ output 1092, and so effecting operation of Gate A 1012 (FIG. 2). The effect of the application of a HI signal to input 1079.i1 of gate 1079 and to input 1090 of credit control means 1070 will be discussed at a later point herein.

Returning now to a discussion of the coin validation means outputs, it may be observed that output lead 1059, upon which a HI signal is produced when a validated dollar coin is detected as having been deposited, is, in addition to the other connections already previously noted, also connected as an input 1096.i4 of AND gate 1096, the output 1096.o of which, designated the Validated Dollar Accept (V$A) output, is connected to an input 1079.i2 of OR gate 1079, to the set S input 1104 of flip-flop 1106, and to input 1110 of credit control means 1070. It will be appreciated by those skilled in the art that a HI signal will be produced on the output 1096.o of AND gate 1096 if the gating condition thereof is satisfied, i.e., if a determination is made that a validated dollar coin may be accepted. In such event, the HI signal produced on the output 1096.o of gate 1096 will be provided to input 1079.i2 of gate 1079, to set S input 1104 of flip-flop 1106, and to input 1110 of credit control means 1070. Application of a HI signal to set S input 1104 of flip-flop 1106 will cause the $\overline{Q}$ output 1112 thereof to go LO, thereby energizing Gate B relay 1114, which is connected between a positive voltage source and output 1113.o of driver means 1113, the input 1113.i of which is connected to $\overline{Q}$ output 1112, and so effecting operation of Gate B 1014 (FIG. 2). The effect of the application of a HI signal to input 1079.i2 of gate 1079 and to input 1110 of credit control means 1070 will be discussed at a later point herein.

It will be readily understood from a review of the table of FIG. 1 that determinations regarding the acceptability of any validated deposited coin depend upon the denomination of the deposited coin, the coin tube status, the vend price, and the accumulated credit. From the foregoing description of the vending system of FIG. 3, it will be appreciated that the AND gates 1076, 1080, 1082, and 1096 form part of the concluding portion of a decoding or determination means 1120 which is so connected in circuit that the ouputs produced thereby are dependent upon such noted data. In the vending system embodiment of FIG. 3, the coin validity data is provided to the determination means 1120 from the coin validation means 1054 in the manner already previously described. The noted vending system embodiment also includes a vend control means 1130 quite similar to the vend control construction depicted in FIG. 1 of U.S. Pat. No. 3,841,456, assigned to a subsidiary of Applicant's assignee, which vend control means 1130 can be advantageously employed to provide to the determination means 1120 the other data necessary to permit a determination to be made.

For ease of understanding and cross-reference, when like components to those employed in the construction of FIG. 1 of U.S. Pat. No. 3,841,456 are depicted in the FIG. 3 embodiment hereof, the same reference numbers utilized in U.S. Pat. No. 3,841,456 are employed. Upon a comparison of FIG. 1 of U.S. Pat. No. 3,841,456 with FIG. 3 herewith, it will be observed that the embodiment of FIG. 3 includes vend/payout/escrow logic means 1132 and vend/selection means 1134, interconnected to one another through a data/control pathway 1136, in place of various block components and associated circuitry depicted in FIG. 1 of U.S. Pat. No. 3,841,456, preferred embodiments of which various block components of such FIG. 1 are set out in greater detail in other figures of U.S. Pat. No. 3,841,456. Such noted difference is meant to be indicative of the fact that many different types of selection, vend, payout, and escrow means and controls therefor can be advantageously utilized in conjunction with the coin acceptance means of the present invention, and that specific constructional details of such means and controls are not critical to the present invention.

It may further be observed from such comparison that the components within block 10 in FIG. 3 herewith correspond to the same numbered components as set forth in FIG. 1 of U.S. Pat. No. 3,841,456, and it will therefore be understood that, insofar as correspondences exist between components of FIG. 1 of U.S. Pat. No. 3,841,456 and components of FIG. 3 herewith, the discussions regarding and the explanations of operation thereof as set forth in U.S. Pat. No. 3,841,456 may be and are intended to be incorporated herein by reference. In light thereof, it will also be understood that a LO signal will be present on output lead 124 from B counter 20 whenever a non-zero value is entered therein, and that a HI signal will be produced on such lead only when such counter has a zero value therein, such as occurs when the counter is reset upon initial power-up or is reset by an $R_B$ signal provided from the vend-/payout/escrow logic means 1132 over lead 170 to the reset R input of such counter. The noted output lead 124 is connected both to input 1140.i2 of NOR gate 1140, the other input 1140.i1 of which is connected to the carry-out $C_o$ output 92 of comparator 16 and the output 1140.o of which is connected to the vend/payout enable input 1142 of vend/payout/escrow logic means 1132, and to an RC circuit including resistor 1144 and capacitor 1146, the purpose of which RC circuit is to provide a HI signal to the enable EN input 128 of price encoder 22 to effect the loading of a vend price into B counter 20 whenever the signal on lead 124 goes HI. Consequently, at the conclusion of each vend operation, following the resetting of B counter 20 in response to an $R_B$ reset signal from vend/payout/escrow logic means 1132, the vend price will be reloaded into the B counter so that the circuitry within block 10 will be properly conditioned for a subsequent vend operation.

As coins are deposited, validated, and accepted, credit will be accumulated in A counter 14, which credit is compared against the vend price in B counter 20 by comparator 16 to provide difference status signals on comparator outputs 78–92. So long as the vend price in the B counter is greater than the credit accumulated in the A counter, a HI signal will be produced on carry-out $C_o$ output 92 of the comparator 16. When the credit accumulated in the A counter 14 equals or exceeds the vend price in the B counter 20, however, a LO signal will be produced on the carry-out $C_o$ output 92 and provided to input 1140.i1 1140.o of NOR gate 1140. Since a LO signal is also being applied to input 1140.i2 of such gate from output 124 of B counter 20 at such time, the output 1140.o of NOR gate 1140 will then go HI and such HI signal will be applied to the vend/payout enable input 1142 of vend/payout/escrow logic means 1132 to effect a vend and the payout of any overdeposit, which payout may be effected in the manner described in U.S. Pat. No. 3,841,456 by incrementing the count in the B counter upon payback of a coin until the count in the B counter 20 equals the count in the A counter 14.

With the foregoing discussion in mind, it will be understood that the status of the $S_1$–$S_5$ outputs 78–86 and the carry-out $C_o$ output 92 of comparator 16 at any given time prior to a vend authorization provides an indication of the existing difference at such time between the vend price and the credit accumulated. The correspondences that exist between various possible difference values and the status of comparator 16 outputs at times prior to vend authorization may be expressed as set forth in the table of FIG. 4. The significance of such table and the correspondences set forth therein will become more apparent from that which follows.

In the FIG. 3 embodiment, the carry-out $C_o$ output 92 of comparator 16 is connected to input 1076.i1 of AND gate 1076, to input 1080.i1 of AND gate 1080, to input 1082.i1 of AND gate 1082, and to input 1096.i1 of AND gate 1096 to ensure both that a validated coin acceptance signal (VNA, VDA, VQA, or V$A) for any validated deposited coin will only be produced prior to a vend authorization, i.e., only at a time when the vend price still exceeds the accumulated credit, and that no validated coin acceptance signal will be able to be produced during vend delivery and payback operations. When a LO signal is produced on output 92, such as occurs when the accumulated credit equals or exceeds the vend price, gates 1076, 1080, 1082, and 1096 will be effectively disabled and production of validated coin acceptance signals will be inhibited. However, when a HI signal is present at carry-out $C_o$ output 92 of comparator 16, as is the case when the vend price is greater than the accumulated credit, it is possible that the gating conditions of any of gates 1076, 1080, 1082, and 1096 can be met.

As may be observed from FIG. 3, the gating conditions for such gates are determined, at least in part, by monitoring the comparator output leads 78–92 and the status of coin tube monitor switches 1148, 108, and 110. The $S_1$–$S_5$ output leads 78–86 are connected, respectively, to inputs 1158–1166 of a decoder means 1170, which decoder means functions to produce appropriate signals corresponding to certain relationships between the vend price and the accumulated credit on outputs 1172–1190 thereof, which outputs are labeled, respectively, 0.05, 0.10, 0.20, $<0.25$, 0.25, 0.50, $\geqq 0.75$, 0.75, $<1.00$, and $0.\times 5$.

Figures 4, 5:
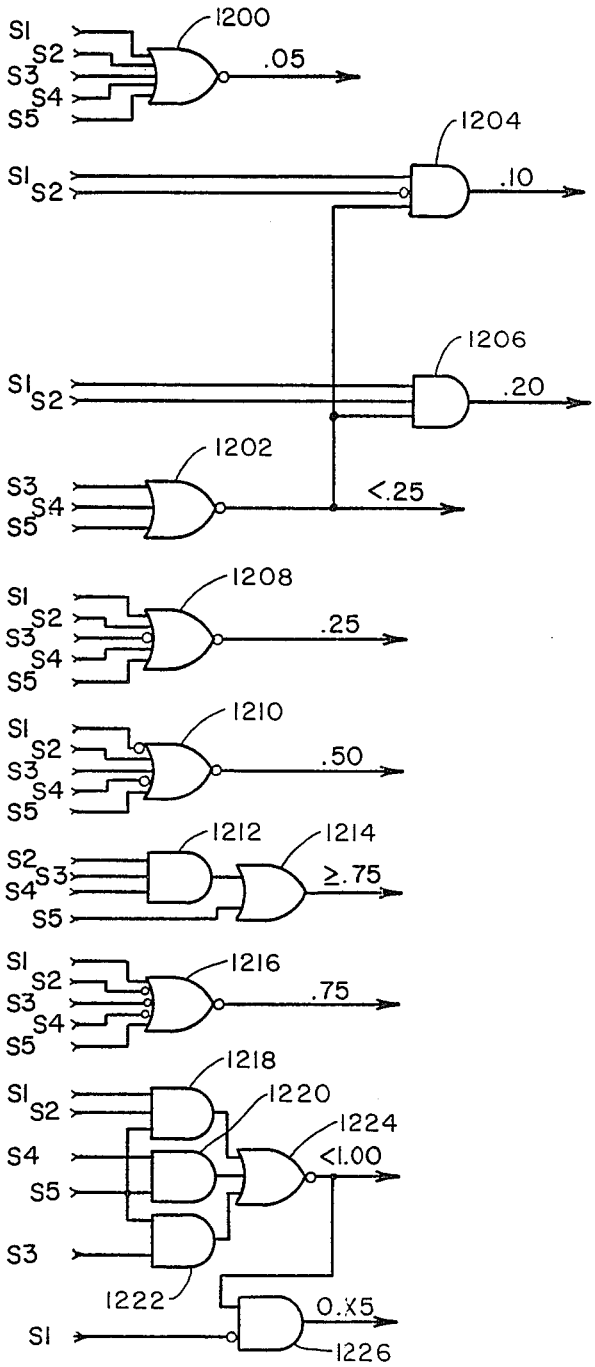
FIG. 4 is a table identifying correspondences between certain money values and the logic levels of the outputs of the comparator block in FIG. 3.
FIG. 5 is a schematic depicting one possible decoding circuitry embodiment that could be employed in one of the decoder blocks of FIG. 3.

FIG. 5 discloses one possible circuit embodiment, including gates 1200–1226, which are connected between labeled $S_1$–$S_5$ inputs (corresponding to inputs 1158–1166 of decoder means 1170) and appropriately labeled outputs (corresponding to outputs 1172–1190 of decoder means 1170) in the manner shown, for decoder means 1170, the truth table for which embodiment is set forth in FIG. 6. The function, interconnection, and operation of such gates will be readily understood by and apparent to those skilled in the art from FIG. 5 and the truth table of FIG. 6.

In the FIG. 3 embodiment, coin availability status is determined by coin tube monitor switches 1148, 108, and 110, which switches respectively detect coin level status in the nickel, dime, and quarter coin payout tubes. Each switch 1148, 108, and 110 is connected such that its respective common terminal is connected to ground and such that its respective closed pole is connected to a positive voltage source through a respective pull-up resistor 1230, 1232, or 1234 and also to a respective input 1240, 1242, or 1244 of decoder means 1250, which inputs are respectively labeled as the NS, DS, and QS inputs. If a switch is maintained in an open condition due to the presence of at least the minimum detectable level of coins in the coin tube with which such switch is associated, a HI signal will be maintained at the appropriate NS, DS, or QS input of decoder means 1250. On the other hand, if a switch closes due to the failure to maintain the level of coins in a coin tube at the minimum level, a LO signal will be applied to the appropriate NS, DS, or QS input of decoder means 1250. Decoder means 1250 functions to produce appropriate signals corresponding to various possible status conditions of the coin tube monitor switches on outputs 1252–1266 thereof, which outputs are labeled, respectively, 000, 001, 010, XX0, 100, X00, 110, and X10.

Figures 7, 8:
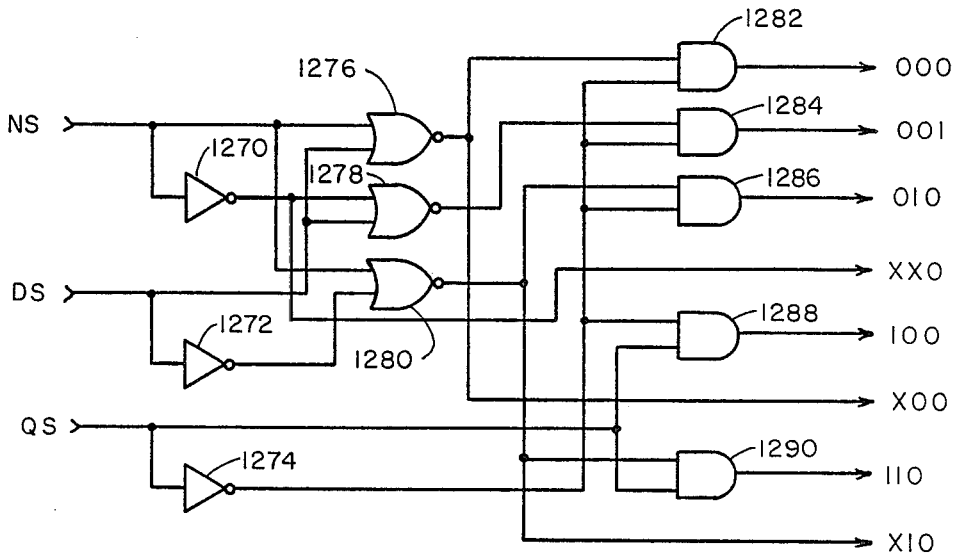
FIG. 7 is a schematic depicting one possible decoding circuitry embodiment that could be employed in another of the decoder blocks of FIG. 3.
FIG. 8 is a truth table for the decoding circuitry embodiment depicted in FIG. 7.

FIG. 7 discloses one possible circuit embodiment, including inverters 1270–1274, NOR gates 1276–1280, and AND gates 1282–1290 all of which are connected in circuit between labeled NS, DS, and QS inputs (corresponding to inputs 1240–1244 of decoder means 1250) and appropriately labeled outputs (corresponding to outputs 1252–1266 of decoder means 1250) in the manner shown, for decoder means 1250, the truth table for which embodiment is set forth in FIG. 8. The function, interconnection, and operation of such logic components will be readily understood by and apparent to those skilled in the art from FIG. 7 and the truth table of FIG. 8.

From the foregoing discussions, and with reference to FIG. 3, it will be appreciated that the status of the outputs of decoder means 1170 is dependent upon the vend price in B counter 20 and the credit accumulated in A counter 14, while the status of the outputs of decoder means 1250 is dependent upon the coin tube switches. As will be recalled from the discussion of the table of FIG. 1, the acceptability of any validated coin may be determined from the vend price, the accumulated credit, and the availability of coins for payback. It will therefore be apparent that, by the use of appropriate gating techniques, the outputs of decoder means 1170 and 1250 may be utilized, along with carry-out $C_o$ output 92 of comparator 16 and the output leads 1056–1059 of coin validation means 1054, to determine the acceptability of any validated deposited coin.

From a review of the table of FIG. 1 it may be observed that a valid nickel may always be accepted prior to a vend authorization. Such condition is readily effected in the embodiment of FIG. 3 by the use of NAND gate 1076, the inputs 1076.i1 and 1076.i2 of which are respectively connected to carry-out $C_o$ output 92 of comparator 16 and to output lead 1056 of coin validation means 1054, as previously described. It will be recalled from the discussions hereinbefore presented that the carry-out $C_o$ output 92 of comparator 16 remains HI so long as the vend price in B counter 20 is greater that the credit accumulated in A counter 14, and that such output 92 goes LO to effect vend authorization, when the accumulated credit at least equals the vend price. Consequently, at any time prior to vend authorization, input 1076.i1 will be maintained HI and the production by coin validation means 1054 of a HI signal on lead 1056, signifying detection of a valid nickel, will therefore effect the production of a HI signal on VNA output 1076.o of AND gate 1076.

From a further review of such table it may be observed that a valid dime may always be accepted prior to vend authorization unless the nickel coin tube is "empty" and the difference between the vend price and the accumulated credit is $.05. The nickel coin tube is considered to be empty whenever the coin tube status is 100, 010, 110, or 000, which status may more conveniently be expressed as XX0. Such noted "acceptability" condition is effectively realized through the use of NAND gate 1310 and AND gate 1080.

The inputs 1310.i1 and 1310.i2 of NAND gate 1310 are respectively connected to 0.05 output 1172 of decoder means 1170 and to XX0 output 1258 of decoder means 1250, and the output 1310.o thereof is connected to input 1080.i2 of AND gate 1080, the other inputs 1080.i1 and 1080.i3 of which are respectively connected to carry-out $C_o$ output 92 of comparator 16 and to output lead 1057 of coin validation means 1054. Prior to vend authorization, the signal at carry-out $C_o$ output 92 of comparator 16 will be HI, and the production by the coin validation means 1054 of a HI signal on lead 1057 will therefore effect a HI signal at VDA output 1080.o of AND gate 1080 unless HI signals are present at such time on both the 0.05 output 1172 of decoder means 1170 and the XX0 output 1258 of decoder means 1250. If HI signals are present at such time on both the 0.05 output 1172 of decoder means 1170 and the XX0 output 1258 of decoder means 1250, a LO signal will be produced on the output 1310.o of NAND gate, which signal will prevent the production of a HI signal on output 1080.o of AND gate 1080 regardless of the signals applied to inputs 1080.i1 and 1080.i3.

Similarly, it may be observed that a valid quarter may be accepted at any time prior to vend authorization unless (1) the coin tube status is X00 and the difference between the vend price and the accumulated credit is less than $.25, or (2) the coin tube status is X10 and the difference between the vend price and the accumulated credit is either $.10 or $.20. Such noted "acceptability" conditions may be effectively realized through the use of NAND gates 1312, 1314, and 1316 and AND gate 1082.

The inputs 1312.i1 and 1312.i2 of NAND gate 1312 are respectively connected to <0.25 output 1178 of decoder means 1170 and to X00 output 1262 of decoder means 1250, while the inputs 1314.i1 and 1314.i2 of NAND gate 1314 are respectively connected to 0.20 output 1176 of decoder means 1170 and to X10 output 1266 of decoder means 1250 and the inputs 1316.i1 and 1316.i2 of NAND gate 1316 are respectively connected to 0.10 output 1174 of decoder means 1170 and to X10 output 1266 of decoder means 1250. The outputs 1312.o, 1314.o, and 1316.o of NAND gates 1312, 1314, and 1316 are respectively connected to inputs 1082.i2, 1082.i3, and 1082.i4 of AND gate 1082, the other inputs 1082.i1 and 1082.i5 of which are respectively connected to the carry-out $C_o$ output 92 of comparator 16 and to the output lead 1058 of coin validation means 1054.

Those skilled in the art will recognize and understand that, at any time prior to vend authorization, the production by the coin validation means 1054 of a HI signal on output lead 1058 will effect the production of a HI signal on VQA output 1082.o of AND gate 1080 unless (1) HI signals are present at such time on both the X00 output 1262 of decoder means 1250 and the <0.25 output 1178 of decoder means 1170, or (2) HI signals are present at such time on the X10 output 1266 of decoder means 1250 and either the 0.10 output 1174 or the 0.20 output 1176 of decoder means 1170. If HI signals are present at such time on both the X00 output 1262 of decoder means 1250 and the <0.25 output 1178 of decoder means 1170, the output 1312.o of NAND gate 1312 will be held LO. Similarly, if HI signals are present at such time on the X10 output 1266 of decoder means 1250 and the 0.10 output 1174 of decoder means 1170, the output 1314.o of NAND gate 1314 will be held LO, and if HI signals are present at such time on the X10 output 1266 of decoder means 1250 and the 0.20 output 1176 of decoder means 1170, the output 1316.o of NAND gate 1316 will be held LO. The presence of a LO signal on the output of any one of the NAND gates 1312, 1314, or 1316 will prevent the production of a HI signal on output 1082.o of AND gate 1082 regardless of the signals applied to inputs 1082.i1 and 1080.i5.

It may also be observed from a review of the table of FIG. 1 that a valid dollar coin may be accepted at any time prior to vend authorization unless (1) the tube status is 001 and the difference between the vend price and the accumulated credit is less than $.75, or (2) the tube status is 100 and the difference between the vend price and the accumulated credit is not equal to $.25, $.50, or $.75, or (3) the tube status is 010 and the difference between the vend price and the accumulated credit is $.05, $.15, $.25, $.35, $.45, $.55, $.65, $.75, $.85, or $.95, or (4) the tube status is 110 and the difference between the vend price and the accumulated credit is either $.85 or $.95, or (5) the tube status is 000 and the difference between the vend price and the accumulated credit is less than $1.00. Such noted "acceptability" conditions may be effectively realized through the use of inverters 1318 and 1320, NOR gate 1322, NAND gates 1324–1332, and AND gates 1334, 1336, and 1096.

The inputs 1322.i1, 1322.i2, and 1322.i3 of NOR gate 1322 are respectively connected to the 25 output 1180, to the 0.50 output 1182, and to the 0.75 output 1186 of decoder means 1170, and the output 1322.o thereof is connected to input 1324.i1 of NAND gate 1324, the other input 1324.i2 of which is connected to 100 output 1260 of decoder means 1250. The inputs 1326.i1 and 1326.i2 of NAND gate 1326 are respectively connected to the output 1318.o of inverter 1318, the input 1318.i of which is connected to the ≧0.75 output 1184 of decoder means 1170, and to 001 output 1254 of decoder means 1250. The inputs 1328.i1 and 1328.i2 of NAND gate 1328 are respectively connected to the 0.×5 output 1190 of decoder means 1170 and to 010 output 1256 of decoder means 1250.

The outputs 1324.o, 1326.o, and 1328.o of NAND gates 1324, 1326, and 1328 are respectively connected to inputs 1334.i1, 1334.i2, and 1334.i3 of AND gate 1334, the output 1334.o of which is connected to input 1096.i2 of AND gate 1096. From previous discussions hereinbefore, it will be recalled that the production of a HI signal on the V$A output 1096.o of AND gate 1096 effects acceptance of a validated dollar coin. Those skilled in the art will recognize that the application of a LO signal to any one of the inputs of AND gate 1096 will be sufficient to prevent the production of a HI signal on output 1096.o thereof regardless of the signals applied to any of the other inputs of such gate.

Consequently, the production of a LO signal on output 1334.o of AND gate 1334, which may be effected by the production of a LO signal on any one of the outputs 1324.o, 1326.o, or 1328.o of NAND gates 1324, 1326, and 1328, would be effective to prevent the production of a HI signal on V$A output 1096.o of AND gate 1096. Those skilled in that art will recognize that a LO signal will be produced on output 1324.o of NAND gate 1324 whenever a HI signal is present on 100 output 1260 of decoder means 1250 and LO signals are present on all of 0.25 output 1180, 0.50 output 1182, and 0.75 output 1186 of decoder means 1170, i.e., whenever the tube status is 100 and the difference between the vend price and the accumulated credit is not equal to $.25, $.50, or $.75. They will also recognize that a LO signal will be produced on output 1326.o of NAND gate 1326 whenever a LO signal is present on 0.75 output 1184 of decoder means 1170 and a HI signal is present on 001 output 1254 of decoder means 1250, i.e., whenever the tube status is 001 and the difference between the vend price and the accumulated credit is less than $.75, and that a LO signal will be produced on output 1328.o of NAND gate 1328 whenever HI signals are present on both 0.X5 output 1190 of decoder means 1170 and 010 output 1256 of decoder means 1250, i.e., whenever the tube status is 010 and the difference between the vend price and the accumulated credit is $.05, $.15, $.25, $.35, $.45, $.55, $.65, $.75, $.85, or $.95.

The inputs 1330.i1, 1330.i2, 1330.i3, 1330.i4, and 1330.i5 of NAND gate 1330 are respectively connected to ≧0.75 output 1184 of decoder means 1170, to 0.X5 output 1190 of decoder means 1170, to <1.00 output 1188 of decoder means 1170, to output 1320.o of inverter 1320, the input 1320.i of which is connected to 0.75 output 1186 of decoder means 1170, and to 110 output 1264 of decoder means 1250. The inputs 1332.i1 and 1332.i2 of NAND gate 1332 are respectively connected to <1.00 output 1188 of decoder means 1170 and to 000 output 1252 of decoder means 1250. The outputs 1330.o and 1332.o of such NAND gates 1330 and 1332 are respectively connected to inputs 1336.i1 and 1336.i2 of AND gate 1336, the output 1336.o of which is connected to input 1096.i3 of AND gate 1096.

In view of the foregoing discussions, those skilled in the art will recognize that the application of a LO signal to input 1096.i3 of AND gate 1096 will be sufficient to prevent the production of a HI signal on output 1096.o thereof regardless of what signals may be applied to any of the other inputs of such gate. Thus, the production of a LO signal on output 1336.o of AND gate 1336, which may be effected by the production of a LO signal on either one of the outputs 1330.o or 1332.o of NAND gates 1330 and 1332, would be effective to prevent the production of a HI signal on V$A output 1096.o of AND gate 1096. Those skilled in the art will recognize that a LO signal will be produced on output 1330.o of NAND gate 1330 whenever HI signals are present on ≧0.75 output 1184 of decoder means 1170, 0.X5 output 1190 of decoder means 1170, 1.00 output 1188 of decoder means 1170, and 110 output 1264 of decoder means 1250, and a LO signal is present on 0.75 output 1186 of decoder means 1170, i.e., whenever the tube status is 110 and the difference between the vend price and the accumulated credit is either $.85 or $0.95, and that a LO signal will be produced on output 1332.o of NAND gate 1332 whenever HI signals are present on both <1.00 output 1188 of decoder means 1170 and 000 output 1252 of decoder means 1250, i.e., whenever the tube status is 000 and the difference between the vend price and the accumulated credit is less than $1.00.

Consequently, in view of circuitry hereinabove described, at any time prior to vend authorization, the production by coin validation means 1054 of a HI signal on lead 1059, signifying detection of a valid dollar coin, will effect a HI signal on V$A output 1096.o of AND gate 1096, the inputs 1096.i1, 1096.i2, 1096.i3, and 1096.i4 of which are respectively connected to carry-out $C_o$ output 92 of comparator means 16, output 1334.o of AND gate 1334, output 1336.o of AND gate 1336, and output lead 1059 of coin validation means 1054, so long as none of the "non-acceptance" conditions as noted in the table of FIG. 1 apply.

In light of all the foregoing, it will be understood that, at any time prior to vend authorization, if a valid coin is detected and a HI signal is produced by coin validation means 1054 on one of the output leads 1056–1059, a HI signal will be produced on an appropriate one of the VNA, VDA, VQA, or V$A outputs unless a "non-acceptance" condition for such coin denomination exists. It should be remembered, however, from discussions presented hereinbefore, that the output leads 1056–1059 are also connected elsewhere, the purpose of which connections has not previously been explained. Such leads 1056–1059 are connected as input leads 1066–1069 to credit control means 1070, and leads 1057–1059 are also connected as inputs to OR gate 1072, the output 1072.o of which is connected to the set S input 1073 of ICM 1074. In order to explain the purpose of such connections, it is desirable that certain other connections first be referenced. Thus, it may be observed that VNA output 1076.o of AND gate 1076, VDA output 1080.o of AND gate 1080, and VQA output 1082.o of AND gate 1082 are all connected as inputs to OR gate 1078, the output 1078.o of which, as has previously been explained, is connected to both input 1090 of credit control means 1070 and input 1079.i1 of OR gate 1079, and V$A output 1096.o is connected to both input 1110 of credit control means 1070 and input 1079.i2 of OR gate 1079. As will be more fully explained in that which follows, the operations of the credit control means 1070 and the ICM 1074 are dependent upon whether or not a validated coin acceptance signal is produced upon an appropriate one of the VNA, VDA, VQA, or V$A outputs in response to production by the coin validation means of a valid coin signal.

Whenever a valid dime, quarter, or dollar coin signal is produced by the coin validation means 1054, ICM 1074 is set by a HI signal applied to set S input 1073. Typically, ICM 1074 may be designed to respond to such set signal to begin a timing out operation, which, if not terminated before a given time, will effect the display of appropriate information or some form of message advising the customer that a different denomination coin must be deposited to obtain a vend since the most recently deposited valid coin, if accepted by the system, might not permit the correct amount of an overdeposit to be returned to him. (Since, in accordance with the table of FIG. 1, a nickel is always acceptable, the valid nickel output lead 1056 need not be connected to NOR gate 1072 to cause the ICM 1074 to be set.) The production of an appropriate validated coin acceptance signal VNA, VDA, NQA, or V$A subsequent to and in response to the production by the coin validation means 1054 of a valid coin signal effects the application, by way of the above-described circuitry, of a HI signal to the reset R input 1088 of ICM 1074. The ICM 1074 will typically be responsive to such reset signal to terminate the timing-out operation then underway and to reset. It will be readily understood that the ICM may take many different forms and that the specific form selected or utilized may be left to the desires of the system designer.

Turning next to a discussion of the credit control means 1070, one can observe that such means is depicted in FIG. 3 by a block having valid coin inputs 1066–1069, validated coin inputs 1090 and 1110, sensor inputs 1350 and 1352, and coin credit outputs 1356–1359, which outputs are connected respectively to inputs 34, 36, 42, and 1365 of programmable clock 12'. In operation, credit control means 1070 of the FIG. 3 embodiment functions to cause the signal on an appropriate coin credit output 1356–1359 to change from a LO state to a HI state when a validated coin acceptance signal is received thereby, and it thereafter responds to receipt of a sensor signal indicating that the validated coin has been appropriately routed or collected to cause the signal on such appropriate coin credit output to return to a LO state.

Figure 9:
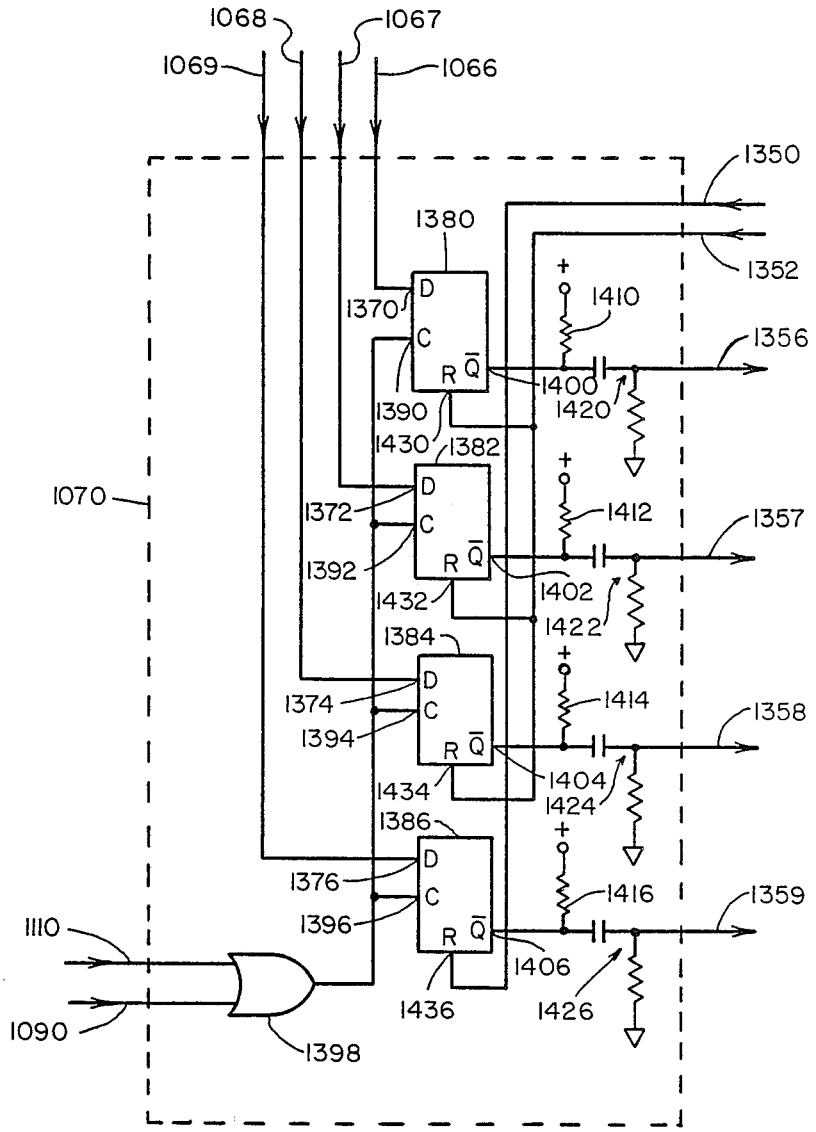
FIG. 9 is a schematic depicting one possible circuitry embodiment that could be employed in the credit control means block of FIG. 3.

FIG. 9 illustrates one possible circuit embodiment for the credit control means 1070. Valid coin inputs 1066–1069 are connected to respective data D inputs 1370, 1372, 1374, and 1376 of D-type flip-flops 1380, 1382, 1384, and 1386, the clock C outputs 1390, 1392, 1394, and 1396 of which are all connected in common to the output 1398.o of OR gate 1398, the inputs 1398.i1 and 1398.i2 of which are connected respectively to validated coin inputs 1110 and 1090. The respective $\overline{Q}$ outputs 1400, 1402, 1404, and 1406 of flip-flops 1380, 1382, 1384, and 1386 are each connected through a respective pull-up resistor 1410, 1412, 1414, 1416 to a positive voltage source and through a respective high-pass RC circuit 1420, 1422, 1424, or 1426 to a respective coin credit output 1356, 1357, 1358, or 1359. Sensor input 1350, which is connected to receive the sensor signal produced by sensing means 1030 (FIG. 2), is connected to the reset R inputs 1430, 1432, and 1434 of flip-flops 1380, 1382, and 1384, and sensor input 1352, which is connected to receive the sensor signal produced by sensing means 1032 (FIG. 2), is connected to the reset R input 1436 of flip-flop 1386.

In operation, if a valid quarter signal is produced oy coin validation means 1054, a HI signal is provided to input 1068 and, therefore, to data D input 1374 of flip-flop 1384. If a VQA signal is not produced because the coin is considered unacceptable under the vend system conditions existing at the time of deposit, no validated coin signal will be produced on input 1090 and no clock signal will therefore be provided to clock C input 1394 of flip-flop 1384. Additionally, since, under such condition, Gate B 1014 (FIG. 2) is not operated due to failure of production of a VQA signal, no sensor signal will be produced to be applied to sensor input 1352. Consequently, if a VQA signal is not produced, the credit control means will not function to effect any change on any coin credit output 1356–1359. On the other hand, if a VQA signal is produced because the coin is considered acceptable, a HI signal will be provided to validated coin input 1090, as a consequence of which the clock C input 1394 of flip-flop 1384 will be clocked, causing $\overline{Q}$ output 1404 to go LO. Due to the production of the VQA signal, Gate A 1012 (FIG. 2) will also have been caused to operate, as has previously been described, as consequence of which the validated quarter will be directed past sensing means 1030 (FIG. 2). When such sensing means detects the passage thereby of such validated quarter it will produce a sensor signal that will be provided to sensor input 1350 to cause a HI signal to be applied to reset R input 1434 of flip-flop 1384, the effect of which signal is to cause $\overline{Q}$ output 1404 of flip-flop 1384 to return HI. It will be understood that the circuitry depicted in FIG. 9 operates in similar fashion with respect to the other denominations of coins to produce on the appropriate coin credit output 1356, 1357, or 1359, in response to an appropriate validated coin acceptance signal, a coin credit signal recognizable as such by the programmable clock 12' (FIG. 3).

Figure 10:
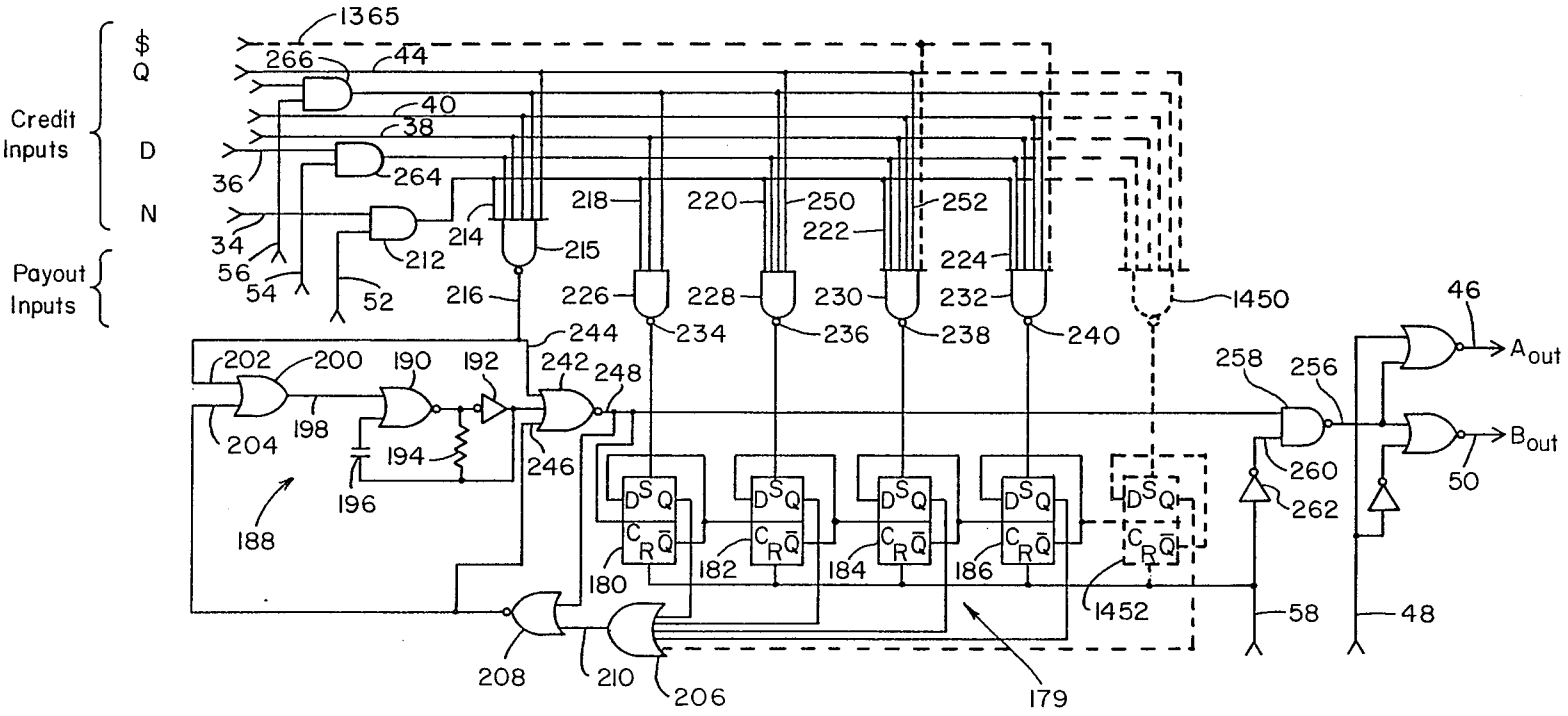
FIG. 10 is a schematic depicting one possible circuitry embodiment that could be employed in the programmable clock block of FIG. 3.

Programmable clock 12' is considered to be essentially identical to the programmable clock 12 depicted in FIG. 1 of U.S. Pat. No. 3,841,456 and described therein, but it includes an additional input 1365 to which a signal may be applied to obtain twenty (20) output pulses on $A_{out}$ lead 46. FIG. 2 of U.S. Pat. No. 3,841,465 depicts a specific circuit construction for a programmable clock, which circuit construction is described as being employable as the programmable clock 12 of FIG. 1 of such patent. FIG. 10 herewith depicts a circuit construction that includes the entirety of the clock circuit construction depicted in FIG. 2 of U.S. Pat. No. 3,841,456, along with an addition thereto, as shown in dotted line in FIG. 10, which addition permits the depicted construction to be responsive to a signal applied to input 1365 to produce twenty (20) output pulses. The noted addition adds a stage, including NAND gate 1450, D-type flip-flop 1452, and interconnections therebetween and to other circuit components, to the counter 179. The function and operation of the circuit construction depicted in FIG. 10 herewith will be obvious to those skilled in the art, especially in view of the description and discussion in U.S. Pat. No. 3,841,456 of the programmable clock construction depicted in FIG. 2 thereof. For ease of understanding and cross-reference, when like components to those employed in the construction of FIG. 2 of U.S. Pat. No. 3,841,456 are depicted in FIG. 10 herewith, the same reference numbers utilized in U.S. Pat. No. 3,841,456 are employed. To the extent to which the components within FIG. 10 herewith correspond to the same numbered components as set forth in FIG. 2 of U.S. Pat. No. 3,841,456, the discussions regarding and the explanations of operation thereof as set forth in U.S. Pat. No. 3,841,456 may be and are intended to be incorporated herein by reference.

In view of all the foregoing, and with reference, now, to FIG. 3, it should now be understood that, when a coin is deposited, if such coin is validated by the coin validation means 1054, an appropriate valid coin signal is produced on one of leads 1056–1059, which signal is provided to the credit control means 1070 and to determination means 1120, and which signal, if representative of a valid dime, quarter, or dollar coin, is also provided to OR gate 1072 in order to effect commencement of a timing-out operation by ICM 1074. Whether or not the determination means 1120 will be responsive to the valid coin signal supplied thereto to produce an appropriate validated coin acceptance signal VNA, VDA, VQA, or V$A, depends upon the vend price, the accumulated credit, and the coin tube status at that time.

If the conditions are such that, in accordance with the table in FIG. 1, the valid deposited coin is considered unacceptable, no validated coin acceptance signal will be produced, as a consequence of which neither of Gates A 1012 or B 1014 will be operated, thereby allowing the deposited coin to follow return path 1015 in the changer unit 1000 and be returned without acceptance to the customer. In addition, the ICM 1074 will complete its timing-out operation and may provide information or some message to the customer. Under such circumstances, the credit control means 1070 will not act to provide any coin credit signals to the programmable clock 12', and the vend control means 1130 will therefore not operate to increase the amount of credit accumulated or to cause a vend operation.

On the other hand, if the conditions are such that, in accordance with the table in FIG. 1, the valid deposited coin is considered acceptable, an appropriate validated coin acceptance signal will be produced by the determination means 1120, as a consequence of which signals will be provided (1) to the credit control means 1070 to condition such means to produce an appropriate coin credit output signal upon the subsequent receipt of an indication that the deposited coin has been properly routed within the changer unit for collection, (2) to the appropriate one of flip-flops 1086 and 1106 to effect operation of the appropriate one of Gates A 1012 or B 1014 (FIG. 2) so that the deposited coin will be properly routed for collection, and (3) to ICM 1074 to terminate the timing-out operation thereof and reset such ICM. Operation of the appropriate one of Gates A 1012 or B 1014 will cause the deposited coin to be routed to pass by the appropriate sensing means 1030 or 1032, which sensing means will produce a sensor signal that is provided to the appropriate sensor input 1350 or 1352 and is therefore supplied both to the appropriate flip-flop 1086 or 1106 to reset it, which action effects termination of operation of the appropriate Gate A 1012 or B 1014, and to credit control means 1070 to effect the production thereby of an appropriate coin credit signal on one of the outputs 1356–1359. The vend control means 1130, and the programmable clock 12' which forms a part thereof, then respond to such coin credit signal in the manner described and set forth in U.S. Pat. No. 3,841,456 to increment the accumulated credit and to effect, in accordance with a vend selection made by the customer through the operation of vend selection means, vend delivery and any required coin payback if the incremented accumulated credit equals or exceeds the vend price.

If the incremented accumulated credit does not equal or exceed the vend price, the vending system 1040 will await further coin deposit or operation of the escrow switch 144. If the customer operates the escrow switch instead of depositing more coins, coin payback may be effected in the manner described and set forth in U.S. Pat. No. 3,841,456. If the escrow switch is not operated and additional coins are deposited, the system will operate in the manner hereinbefore described to determine whether or not to accept the coins, even if valid, and to increment the accumulated credit. Unless escrow switch 144 is operated prior to vend authorization, coin deposit may continue until vend authorization is realized. As has been described hereinbefore, upon the completion of vend delivery and coin payback operations, the established vend price is reloaded into B counter 20 so that the system 1040, and the vend control means 1130 forming a part thereof, will be conditioned for further vend operations.

Figure 11:
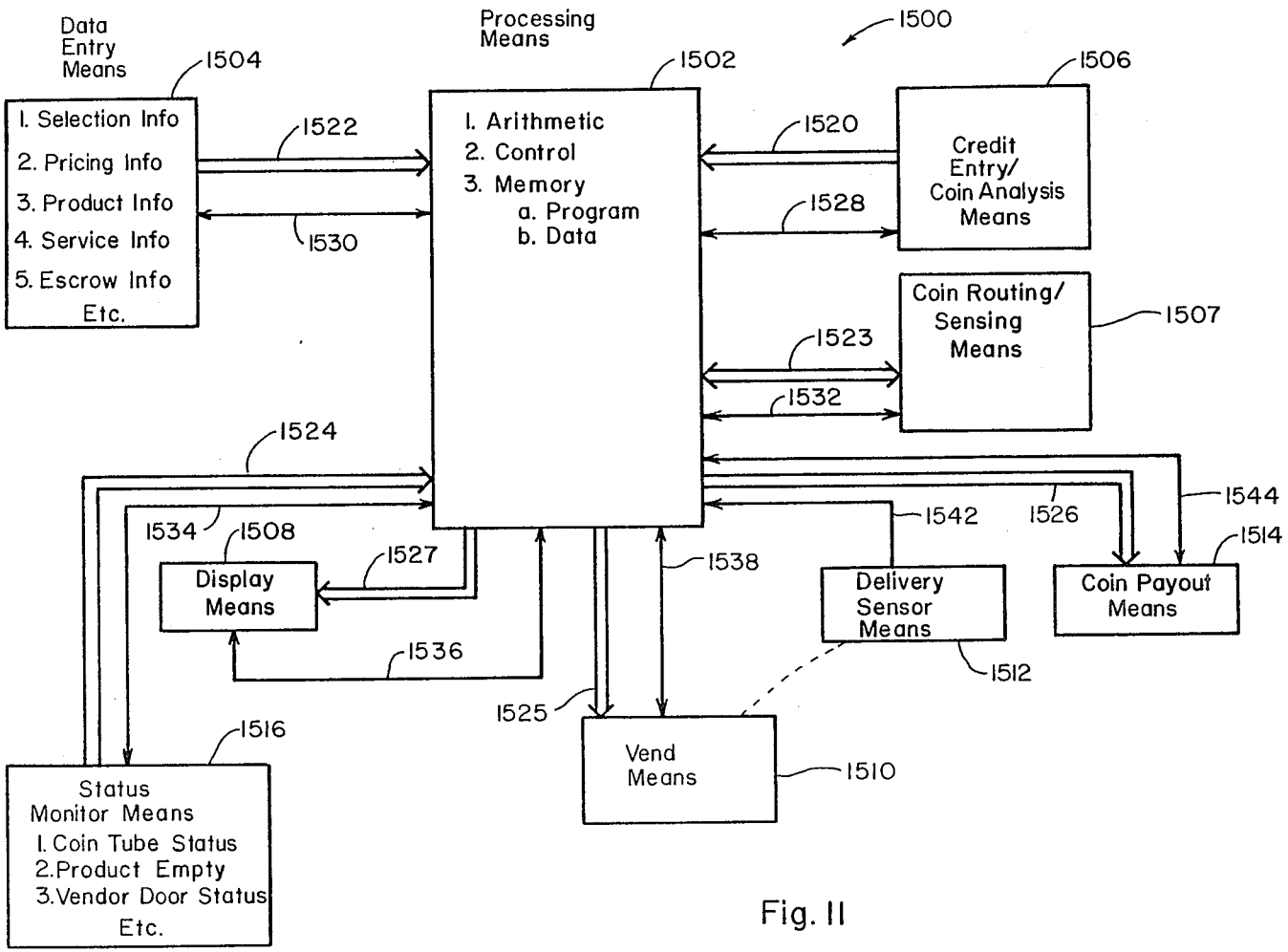
FIG. 11 is a block diagram of another vending system embodiment in which the coin acceptance means includes a programmed microprocessor.

The foregoing description has been primarily directed to a hardwired embodiment of the invention wherein the coin acceptance means is essentially separate from the vend control means. In many respects, the coin acceptance means of the FIG. 3 embodiment may be viewed as being physically installed as an intermediate component between, on one side thereof, coin validation means, controllable means for effecting the acceptance of a given coin, and coin tube monitor means, and, on the other side thereof, the vend control means. It should also be realized, however, that other embodiments and configurations of the subject coin acceptance means are possible and contemplated, including embodiments that employ microprocessor constructions. With some of such embodiments the coin acceptance means may be incorporated within or form a part of the vending control means rather than being a separate component. FIG. 11 depicts in block form a microprocessor controlled vending system embodiment in which the coin acceptance means may form a part of the vend control means. Number 1500 refers to the microprocessor controlled vending system that includes a processing means 1502, data entry means 1504, credit entry/coin analysis means 1506, coin routing/sensing means 1507, display means 1508, vend means 1510, delivery sensor means 1512, coin payout means 1514, and status monitor means 1516. The processing means 1502 includes memory means as well as arithmetic and control means typical of a microprocessor controlled vending system. In the FIG. 11 embodiment coin analysis data may be supplied from the credit entry/coin analysis means 1506 to the processing means 1502 by means of a data path 1520, data information of various types, including selection information, pricing information, product information, and service information, may be provided from the data entry means 1504 to the processing means 1502 by means of a data path 1522, coin routing/sensing data may be provided from the coin routing/sensing means 1507 to the processing means 1502 by means of a data path 1523, and status data, including coin tube status information, product empty information, and vendor status information, may be provided from the status monitor means 1516 to the processing means 1502 by means of a data path 1524. Data for vend purposes may be provided from the processing means 1502 to vend means 1510 by way of data path 1525, coin payout data may be provided from the processing means 1502 to coin payout means 1514 by way of data path 1526, and information for display may be communicated from the processing means 1502 to display means 1508 by means of a data path 1527. Various control and status signals may be intercommunicated among the components of the microprocessor controlled vending system by means of signal paths 1528, 1530, 1532, 1534, 1536, 1538, 1542, and 1544.

Figure 12:
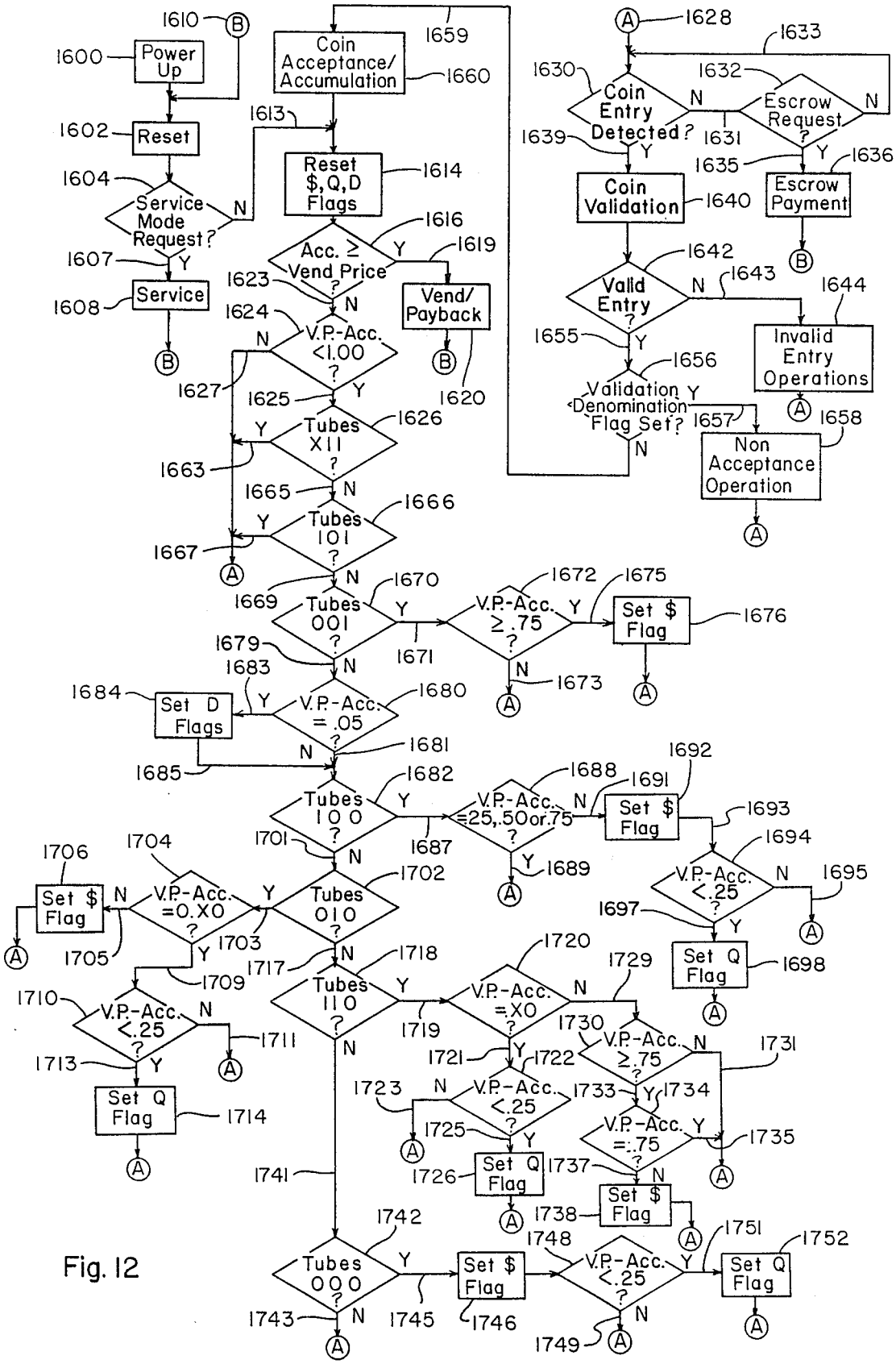
FIG. 12 is a flowchart for a program of the type that may be utilized with the embodiment of FIG. 11.

FIG. 12 is a functional flow chart presenting, in part, a typical sequence of events in the functioning of a microprocessor controlled vending system such as that depicted in FIG. 11, it being understood that the particular sequence of operation of a microprocessor controlled vending system is controlled by the resident control program, often present as firmware, in the system. Referring, now, to the functional flow chart of FIG. 12 as it relates to microprocessor controlled vending system 1500 and the subject coin acceptance means, number 1600 refers to a Power Up operation block, in accordance with which the processing means effects the initialization of the system 1500. Upon completion of power up operations, the operational sequence proceeds to a Reset block 1602, in accordance with which the processing means 1502 operates to reset various values and system components so that they will be properly conditioned for vend operations. If the microprocessor controlled vending system 1500 is employed in a single price vending machine, such resetting operations might typically include ensuring that the the correct vend price has been entered and is available for use by the processing means during vend operations.

Upon completion of reset operations, the operational sequence next proceeds, in accordance with decision block 1604, to check whether any service mode request has been made or is pending. Such service mode request might typically be a request produced in response to operation of some actuatable means included within or forming part of data entry means 1504 or a request attributable to data or status signals provided from the status monitor means 1516 to the processing means 1502. For purposes of the present discussion, neither the source of such a request nor the nature thereof is particularly pertinent with respect to the subject coin acceptance means. If a service mode request is detected, the operational sequence will proceed along path 1607 to service block 1608, in accordance with which the processing means 1502 will effect the required service operations before returning to sequence entry point B 1610. If no service mode request is detected, the operational seqence will, instead, follow path 1613 and proceed to operation block 1614.

In accordance with block 1614 the processing means 1502 will effect a resetting of dollar ($), quarter (Q), and dime ($) flags, which flags are maintained by the processing means as indicators which may be checked at an appropriate time during the operational sequence to readily verify whether or not a valid coin of the denomination associated with the flag may be accepted by the vending system 1500. Upon completion of such flag resetting, the operational sequence will proceed to decision block 1616, in accordance with which the processing means will check whether the accumulated credit (Acc.) is greater than or equal to the vend price (V.P.).

If the accumulated credit is greater than or equal to the vend price, the operational sequence will proceed along path 1619 to operation block 1620, in accordance with which the processing means 1502 will operate, pursuant to the vend selection made by the customer, to effect both vend delivery and payback, as may be required, of any overdeposit. Upon completion of such operations, the operational sequence will proceed to sequence entry point B 1610.

If the accumulated credit is not greater than or equal to the vend price, the operational sequence will, instead, proceed along path 1623 to decision block 1624. If the difference between the vend price and the accumulated credit is less than $1.00, the operational sequence will follow path 1625 and proceed to decision block 1626, but if the difference is not less than $1.00, the operational sequence will instead follow path 1627 and proceed to sequence entry point A 1628.

At this point, it should be noted that decision block 1624 and the various decision blocks thereunder that may be accessed before proceeding to sequence entry point A 1628 are all directed to establishing the status of the coin flags. Under any given set of conditions, the operational sequence will proceed to sequence entry point A 1628 only when all appropriate coin flags have been set. It will be observed from the discussions and explanations which follow that, in following the operational sequence, the coin flags will be set to conform to the various coin unacceptabilty conditions detailed in the table of FIG. 1.

As has been explained, if, at block 1624, the difference between the vend price and the accumulated credit is not less than $1.00, i.e., if such difference is greater than or equal to $1.00, the operational sequence will proceed to sequence entry point A 1628, signifying that all necessary coin flags have been set. It will be recalled that, in proceeding through the operational sequence described hereinbefore, all of the coin flags were reset at block 1614, and none were thereafter set. Such coin flag status conforms with the correspondences set forth in the table of FIG. 1. In such table, no coin unacceptability indications appear for any difference value greater than or equal to $1.00. It will be appreciated that similar conformity between the coin flags that are set and the entries appearing in the table of FIG. 1 may be hereafter observed as different paths in the flowchart of FIG. 12, are followed, which different paths are associated with different vend conditions.

Turning, next, to a discussion of the operational sequence that will be followed whenever all requisite coin flags have been set and entry at sequence entry point A 1628 is effected, it may be observed that the processing means 1502 will enter a looping sequence denoted by Coin Entry Detected? decision block 1630, branch path 1631, Escrow Request? decision block 1632, and branch path 1633, in which looping sequence the processing means is checking for detection of either a coin deposit or an escrow request. Typically, an escrow request might be produced by data entry means 1504 and provided to processing means 1502 in response to actuation by the customer of some form of escrow switch. Data or information signifying credit entry detection might typically be provided in response to the deposit by a customer of a coin by either the credit entry/coin analysis means 1506 or the coin routing/sensing means 1507. If an escrow request is detected first at block 1632, the operational sequence will exit such looping sequence by following path 1635 from decision block 1632 to operation block 1636, in accordance with which the processing means 1502 will effect escrow payback before returning to sequence entry point B 1610.

On the other hand, if a coin entry is detected first at block 1630, the operational sequence will exit such looping sequence by following path 1639 from decision block 1630 to Coin Validation operation block 1640. In accordance with block 1640, and depending upon the constructional details of the vending system 1500 and the various components thereof, the processing means may effect some operation by the credit entry/coin analysis means 1506 to cause the production and/or supply of coin analysis data thereby to such processing means, or it may simply receive coin analysis data already being supplied by the credit entry/coin analysis means 1506. Regardless of the nature or extent of coin validation operations performed by or under control of the processing means 1502, when such operations are completed, the operational sequence will proceed to Valid Entry? decision block 1642.

In accordance with block 1642, the processing means 1502 will typically analyze the coin analysis data supplied to it by the credit entry/coin analysis means 1506 to determine whether or not the deposited coin is considered to be a valid coin. If the coin is not considered to be valid, the operational sequence will follow path 1643 to operation block 1644, in accordance with which the processing means will effect and control invalid entry operations, which actions could take many forms, before returning to sequence entry point A 1610. If the coin is considered valid, however, the operational sequence will follow path 1655 to decision block 1656.

At block 1656 the processing means will check to determine whether the coin flag that corresponds to the particular denomination of the deposited valid coin is set. If the coin flag corresponding to the denomination of the deposited valid coin is set, such deposited coin, even though valid, is considered unacceptable. In such a situation, the operational sequence will follow path 1657 to operation block 1658, in accordance with which the processing means will then, depending upon the specific design and construction of the vending system 1500, effect and control appropriate non-acceptance operations, which operations might typically include the display of some information or message by the display means 1508 and/or some action or inhibition of action by the coin routing/sensing means 1507 under control of the processing means 1502.

On the other hand, if the coin flag corresponding to the denomination of the deposited valid coin is not set, such deposited coin is considered acceptable. In such a situation, the operational sequence, instead of following path 1657 to operation block 1658, will follow path 1659 to operation block 1660. In accordance with such block 1660, the processing means 1502 will then effect and control the acceptance of such deposited coin and the incrementation of the accumulated credit to reflect the acceptance of such deposited coin. In effecting the acceptance of such deposited coin the processing means 1502 will typically cause the coin routing/sensing means 1506 to route the coin in an appropriate manner to effect collection thereof, and it may await indications from sensing means associated with or forming a part of the coin routing/sensing means 1506 that the coin has been appropriately routed or has reached a particular point before incrementing the accumulated credit.

Upon completion of the coin acceptance and accumulation operations by the processing means 1502, the operational sequence will return to operation block 1614, which block has already been previously discussed.

Returning, now, to a discussion of decision block 1624, it may be recalled that the processing means will follow path 1625 therefrom to decision block 1626 if the diference between the vend price and the accumulated credit is not less than $1.00, i.e., if it is greater than or equal to $1.00. In accordance with block 1626 the processing means checks to determine whether the coin tube status is X11, and, if so, the operational sequence proceeds via path 1663 to sequence entry point A 1628. If the coin tube status is not X11, the operational sequence proceeds, instead, along path 1665 to decision block 1666. Typically, the processing means 1502 monitors data or information supplied to it from status monitor means 1516 to determine coin tube status.

At block 1666 the processing means checks to determine whether the coin tube status is 101. If so, the operational sequence follows path 1667 and proceeds to sequence entry point A 1628; if not, the operational sequence follows path 1669 to decision block 1670.

At block 1670 the processing means checks to determine whether the coin tube status is 001. If so, the operational sequence follows path 1671 to decision block 1672, in accordance with which the processing means then checks to determine if the difference between the vend price and the accumulated credit is greater than or equal to $.75. If such difference is not greater than or equal to $.75, i.e., if it is less than $.75, the operational sequence follows path 1673 and proceeds to sequence entry point A 1628. However, if the difference is greater than or equal to $.75, the operational sequence follows path 1675 to operation block 1676, in accordance with which the processing means causes the dollar ($) flag to be set. The operational sequence thereafter proceeds to sequence entry point A 1628.

If the coin tube status is determined to be something other than 001 at block 1670, the operational sequence follows path 1679 to decision block 1680. At block 1680 the processing means checks to determine whether or not the difference between the vend price and the accumulated credit is $.05. If not, the operational sequence follows path 1681 directly to decision block 1682. If so, before proceeding to decision block 1682, the operational sequence follows path 1683 to operation block 1684, in accordance with which the processing means causes the dime (D) flag to be set, and then follows path 1685 to decision block 1682.

At block 1682 the processing means checks to determine whether the coin tube status is 100. If so, the operational sequence follows path 1687 to decision block 1688, in accordance with which the processing means then checks to determine if the difference between the vend price and the accumulated credit is $.25, $.50, or $.75. If so, the operational sequence then follows path 1689 and proceeds to sequence entry point A 1628.

However, if the difference at block 1688 is not $.25, $.50, or $.75, the operational sequence follows path 1691 to operation block 1692. In accordance with block 1692 the processing means causes the dollar ($) flag to be set, and the operational sequence thereafter follows path 1693 to decision block 1694. At block 1694 the processing means then checks to determine if the difference between the vend price and the accumulated credit is <$.25. If not, i.e., if the difference is ≧$0.25, the operational sequence then follows path 1695 and proceeds to sequence entry point A 1628. If the difference at block 1694 is <$.25, though, the operational sequence follows path 1697 to operation block 1698, in accordance with which the processing means causes the quarter (Q) flag to be set. The operational sequence thereafter proceeds from block 1698 to sequence entry point A 1628.

Back at block 1682, if the coin tube status is determined to be something other than 100, the operational sequence follows path 1701 to decision block 1702. At block 1702 the processing means checks to determine whether or not the coin tube status is 010. If so, the operational sequence follows path 1703 to decision block 1704, in accordance with which the processing means then checks to determine if the difference between the vend price and the accumulated credit is $.0. If not, the operational sequence follows path 1705 to operation block 1706, in accordance with which the processing means causes the dollar ($) flag to be set. The operational sequence thereafter proceeds from block 1706 to sequence entry point A 1628.

At block 1704, if the difference between the vend price and the accumulated credit is determined to be equal to $0.×0, the operational sequence follows path 1709 to decision block 1710. At block 1710 the processing means then checks to determine if the difference between the vend price and the accumulated credit is <$ 0.25. If not, i.e., if the difference is <$.25, the operational sequence follows path 1711 and proceeds to sequence entry point A 1628. If the difference at block 1710 is <$.25, though, the operational sequence follows path 1713 to operation block 1714, in accordance with which the processing means causes the quarter (Q) flag to be set. The operational sequence thereafter proceeds from block 1714 to sequence entry point A 1628.

Back at block 1702, if the coin tube status is determined to be something other than 010, the operational sequence follows path 1717 to decision block 1718. At block 1718 the processing means checks to determine whether or not the coin tube status is 110. If so, the operational sequence follows path 1719 to decision block 1720, in accordance with which the processing means then checks to determine if the difference between the vend price and the accumulated credit is <$0.X0. If the difference between the vend price and the accumulated credit is determined to be equal to <$0.X0, the operational sequence follows path 1721 to decision block 1722. At block 1722 the processing means then checks to determine if the difference between the vend price and the accumulated credit is <$.25. If not, i.e., if the difference is ≧$.25, the operational sequence then follows path 1723 and proceeds to sequence entry point A 1628. If the difference at block 1722 is <$.25, though, the operational sequence follows path 1725 to operation block 1726, in accordance with which the processing means causes the quarter (Q) flag to be set. The operational sequence thereafter proceeds from block 1726 to sequence entry point A 1628.

At block 1720, if the difference between the vend price and the accumulated credit is not equal to $0X0, the operational sequence follows path 1729 to decision block 1730, in accordance with which the processing means then checks to determine if the difference between the vend price and the accumulated credit is greater than or equal to $.75. If not, the operational sequence follows path 1731 and proceeds to sequence entry point A 1628; if so, the operational sequence follows path 1733 to decision block 1734. At block 1734 the processing means next checks to determine if the difference between the vend price and the accumulated credit is $0.75. If so, the operational sequence then follows path 1735 and proceeds to sequence entry point A 1628. If the difference at block 1734 is not $.75, though, the operational sequence follows path 1737 to operation block 1738, in accordance with which the processing means causes the dollar ($) flag to be set. The operational sequence thereafter proceeds from block 1738 to sequence entry point A 1628.

Back at block 1718, if the coin tube status is determined to be something other than 110, the operational sequence follows path 1741 to decision block 1742. At block 1742 the processing means checks to determine whether or not the coin tube status is 000. If not, the operational sequence follows path 1743 and proceeds to sequence entry point A 1628. If the coin tube status at block 1742 is determined to be 000, though, the operational sequence follows path 1745 to operation block 1746, in accordance with which the processing means causes the dollar ($) flag to be set. Thereafter, the operational sequence proceeds to decision block 1748, at which block the processing means then checks to determine if the difference between the vend price and the accumulated credit is <$.25. If not, i.e., if the difference is ≧$.25, the operational sequence then follows path 1749 and proceeds to sequence entry point A 1628. If the difference at block 1748 is <$.25, though, the operational sequence follows path 1751 to operation block 1752, in accordance with which the processing means causes the quarter (Q) flag to be set. The operational sequence thereafter proceeds from block 1752 to sequence entry point A 1628.

It will be appreciated by those skilled in the art that the foregoing illustrates only one of many possible flow chart configurations that could be utilized with a microprocessor controlled vending system to realize the advantages sought by the use of the subject coin acceptance means. It will be readily apparent that many other flow chart configurations might be equally as well utilized, including flow chart configurations in accordance with with a microprocessor may be programmed to perform a table look-up for information corresponding to entries in the table of FIG. 1. It will also be appreciated that, if so desired, such varied flow chart configurations can generally be implemented in hardwired constructions to the same effect and with comparable results.

It should also be recognized that the embodiments described herein have been described and discussed with reference to coin tube monitor switches that are set to detect "empty" conditions if the quarter tube has less than four (4) quarters therein, if the dime tube has less than (9) dimes therein, and if the nickel tube has less than five (5) nickels therein. If different minimum coin levels are established or utilized for determining tube "empty" conditions in any given vending system, a new table similar to the table of FIG. 1 may be developed or constructed, in accordance with which coin acceptance means according to the present invention may be designed and constructed for use with such given vending system.

It should further be recognized that, with some vending systems, means other than coin tube monitors may be employed to monitor, record, or otherwise maintain coin availability status data or information, one of which means is disclosed in U.S. Pat. No. 4,587,984, assigned to a subsidiary of Applicant's assignee. Many other means for similar purposes could also be employed in place of the coin tube monitor switches.

In light of all the foregoing, it will be apparent that there has thus been shown and described a novel coin acceptance means and method which fulfills the various objects and advantages sought therefor. It will be further apparent to those skilled in the art, however, that many changes, modifications, variations, and other uses and applications of the subject coin acceptance means and method are possible and contemplated. All such changes, modifications, variations, and other uses and applications which do not depart from the spirit and scope of this invention are deemed to be covered by this invention, which is limited only by the claims which follow.

What is claimed is:

1. Coin acceptance means for a vending system wherein a vend price for a given vend operation is established prior to the deposit of coins or submission of credit with regard to such particular vend operation and wherein coins may thereafter be deposited during such particular vend operation to accumulate credit upon the acceptance thereof, such vending system including coin analysis means for analyzing deposited coins, such coin analysis means producing coin analysis data, controllable means for effecting the acceptance or return of deposited coins, coin availability status means for determining coins available for payback, such coin availability status means producing coin availability status data indicative of the status of coins available for payback, and vend control means for controlling a vend operation, such vend control means operable to accumulate credit upon the acceptance of a coin and to effect a vend when the amount of credit accumulate at least equals the vend price, said coin acceptance means operatively connected to the responsive to the production of coin analysis data representative of a valid deposited coin to determine the acceptability of such valid deposited coin for the particular vend operation in progress, such determination dependent upon the vend price, the accumulated credit, the coin analysis data for the valid deposited coin, and the coin availability status data, and to effect acceptance of such valid deposited coin by the controllable means and accumulation by the vend control means of additional credit corresponding to the value of such valid deposited coin unless such additional credit accumulation would result in a credit accumulation in excess of the established vend price the correct amount of which excess credit accumulation would be unavailable in coins available for payback.

2. The coin acceptance means of claim 1 wherein said coin acceptance means includes coin validation means operatively connected to receive the coin analysis data, said coin validation means operatively connected to be responsive to the production of coin analysis data to produce a coin validation data signal upon detection of a valid deposited coin, determination means operatively connected to be responsive to the production of said coin validation data signal to produce a validated coin acceptance signal if the valid deposited coin is considered acceptable based upon the vend price, the accumulated credit, said coin validation data signal, and the coin availability status data, and credit control means operatively connected to be responsive to production of said validated coin acceptance signal to effect the additional credit accumulation by the vend control means.

3. The coin acceptance means of claim 2 wherein said determination means includes decoding means operatively connected to the vend control means and the coin availability status means to receive therefrom data regarding the vend price, the accumulated credit, and coin availability for payback, said decoding means having a plurality of outputs and producing status decode signals at selected outputs thereof depending upon the particular data received by said decoding means at any given time, and gating means operatively connected to receive said status decode signals and said coin validation data signal, said gating means responsive to the production of said coin validation data signal to produce a validated coin acceptance signal only if certain ones of said status decode signals are being produced at such time by said decoding means.

4. The coin acceptance means of claim 3 wherein the coin availability status means includes coin tube monitor means and wherein said decoding means includes a decoder means operatively connected to the coin tube monitor means, said decoder means having a plurality of outputs corresponding to various coin tube status conditions.

5. The coin acceptance means of claim 3 wherein said decoding means includes a decoder means operatively connected to the vend control means, said decoder means having a plurality of outputs corresponding to various difference values between the vend price and the accumulated credit.

6. The coin acceptance means of claim 3 wherein the coin availability status means includes coin tube monitor means and wherein said decoding means includes first and second decoder means, said first decoder means operatively connected to the coin tube monitor means and having a plurality of outputs corresponding to various coin tube status conditions, said second decoder means operatively connected to the vend control means and having a plurality of outputs corresponding to various difference values between the vend price and the accumulated credit.

7. The coin acceptance means of claim 1 wherein the vending system includes coin validation means operatively connected to the coin analysis means to receive therefrom the coin analysis data and to produce a coin validation data signal upon detection of a valid deposited coin, said coin acceptance means including determination means operatively connected to be responsive to the production of said coin validation data signal to produce a validated coin acceptance signal if the valid deposited coin is considered acceptable based upon the vend price, the accumulated credit, said coin validation data signal, and the coin availability status data, and credit control means operatively connected to be responsive to production of said validated coin acceptance signal to effect the additional credit accumulation by the vend control means.

8. The coin acceptance means of claim 7 wherein said determination means includes decoding means operatively connected to the vend control means and the coin availability status means to receive therefrom data regarding the vend price, the accumulated credit, and coin availability for payback, said decoding means having a plurality of outputs and producing status decode signals at selected outputs thereof depending upon the particular data received by said decoding means at any given time, and gating means operatively connected to receive said status decode signals and said coin validation data signal, said gating means responsive to the production of said coin validation data signal to produce a validated coin acceptance signal only if certain ones of said status decode signals are being produced at such time by said decoding means.

9. The coin acceptance means of claim 1 including a processing means forming part of the vend control means.

10. The coin acceptance means of claim 9 wherein said processing means includes a programmed microprocessor.

11. The coin acceptance means of claim 10 wherein said microprocessor is programmed to (a) be responsive to the next production of coin analysis data representative of a valid deposited coin to continue to step (b), (b) determine whether or not such valid deposited coin will be accepted, such determination being dependent upon the vend price, the accumulated credit, the coin analysis data for the valid deposited coin, and the coin availability status data, and, (i) if such valid deposited coin is to be accepted, to continue to step (c), (ii) otherwise, to return to step (a), (c) effect acceptance of such valid deposited coin by the controllable means and accumulation by the vend control means of additional credit corresponding to the value of such valid deposited coin.

12. The coin acceptance means of claim 11 wherein said microprocessor is programmed in step (b) to determine to accept such valid deposited coin only if the additional credit accumulation that will be attributable to such coin, if accepted, will not result in a creadit accumulation in excess of the established vend price the correct amount of which excess credit accumulation would be unavailable in coins available for payback.

13. The coin acceptance means of claim 11 wherein different combinations of the vend price, the accumulated credit, coin analysis data, and coin availability status data are stored in a look-up table, and wherein said microprocessor is programmed in step (b) to perform table look-up operations to determine the acceptability of the valid deposited coin under the particular combination condition then existing.

14. Coin acceptance means for a vending system wherein a vend price for a given vend operation is established prior to the deposit of coins or submission of credit with regard to such particular vend operation and wherein coins may thereafter be deposited during such particular vend operation to accumulate credit upon the acceptance thereof, such vending system including coin analysis means for analyzing deposited coins, such coin analysis means producing coin analysis data, controllable means for effecting the acceptance or return of deposited coins, coin availability status means for determining coins available for payback, such coin availability status means producing coin availability status data indicative of the status of coins available for payback, and vend control means for controlling a vend operation, the vend control means including means for storing the vend price and the credit accumulated, such vend control means operable to accumulate credit upon the acceptance of a coin and to effect a vend when the amount of credit accumulated at least equals the vend price, said coin acceptance means including a processing means forming part of the vend control means, said processing means operatively connected to the means for storing the vend price and the accumulated credit and operable to permit retrieval from such storage means of such stored vend price and accumulated credit, said processing means also operatively connected to receive coin availabilty status data and coin analysis data, said processing means operatively connected to the controllable means to control such means and the acceptance or return thereby of each validated deposited coin, said processing means responsive to the production of coin analysis data representative of a valid deposited coin to determine the acceptability of such valid deposited coin for the particular vend operation in progress, such determination dependent upon the vend price, the accumulated credit, the coin analysis data for the valid deposited coin, and the coin availability status data, said processing means effecting acceptance of such valid deposited coin by the controllable means and accumulation by the vend control means of additional credit corresponding to the value of such valid deposited coin unless such additional credit accumulation would result in a credit accumulation in excess of the established vend price the correct amount of which excess credit accumulation would be unavailable in coins available for payback.

15. The coin acceptance means of claim 14 wherein said processing means includes a programmed microprocessor.

16. The coin acceptance means of claim 15 wherein said microprocessor is programmed to (a) be responsive to the next production of coin analysis data representative of a valid deposited coin to continue to step (b), (b) determine whether or not such valid deposited coin will be accepted, such determination being dependent upon the vend price, the accumulated credit, the coin analysis data for the valid deposited coin, and the coin availability status data, and, (i) if such valid deposited coin is to be accepted, to continue to step (c), (ii) otherwise, to return to step (a), (c) effect acceptance of such valid deposited coin by the controllable means and accumulation by the vend control means of additional credit corresponding to the value of such valid deposited coin.

17. The coin acceptance means of claim 16 wherein said microprocessor is programmed in step (b) to determine to accept such valid deposited coin only if the additional credit accumulation that will be attributable to such coin, if accepted, will not result in a credit accumulation in excess of the established vend price the correct amount of which excess credit accumulation would be unavailable in coins available for payback.

18. Coin acceptance means for a vending system wherein a vend price for a given vend operation is established prior to the deposit of coins or submission of credit with regard to such particular vend operation and wherein coins may thereafter to deposited during such particular vend operation to accumulate credit upon the acceptance thereof, such vending system including coin validation means for detecting and validating deposited coins, said coin validation means operable to produce coin validity data upon the detection thereby of a valid deposited coin, controllable means for effecting the acceptance or return of deposited coins, coin availability status means for determining coins available for payback, such coin availability status means producing coin availability status data indicative of the status of coins available for payback, and vend control means for controlling a vend operation, the vend control means including means for storing the vend price and the credit accumulated, such vend control means operable to accumulate credit upon the acceptance of a coin and to effect a vend when the amount of credit accumulated at least equals the vend price, said coin acceptance means including a processing means forming part of the vend control means, said processing means operatively connected to the means for storing the vend price and the accumulated credit and operable to permit retrieval from such storage means of such stored vend price and accumulated credit, said processing means also operatively connected to receive coin availability status data and coin validity, said processing means operatively connected to the controllable means to control such means and the acceptance or return thereby of each validated deposited coin, said processing means responsive to the production of coin validity data upon the detection by the coin validation means of a valid deposited coin to determine the acceptability of such validated deposited coin for the particular vend operation in progress, such determination dependent upon the vend price, the accumulated credit, the coin validity data for the validated deposited coin, and the coin availability status data, said processing means effecting acceptance of such valid deposited coin by the controllable means and the accumulation by the vend control means of additional credit corresponding to the value of such validated coin unless such additional credit accumulation would result in a credit accumulation in excess of the established vend price the correct amount of which excess credit accumulation would be unavailable in coins available for payback.

19. A vending system wherein a vend price for a given vend operation is established prior to the deposit of coins or submission of credit with regard to such particular vend operation and wherein coins may thereafter to deposited during such particular vend operation to accumulate credit upon the acceptance thereof, said vending system including coin analysis means for analyzing deposited coins, said coin analysis means operable to produce coin analysis data, controllable means for effecting the acceptance or return of deposited coins, coin availability status means for determining coins available for payback, said coin availability status means producing coin availability status data indicative of the status of coins available for payback, and processing means for controlling a vend operation, said processing means including means for storing the vend price and the credit accumulated and being operable to accumulate credit upon the acceptance of a coin and to effect a vend when the amount of credit accumulated at least equals the vend price, said processing means operatively connected to the means for storing the vend price and the accumulated credit and operable to permit retrieval from said storage means of such stored vend price and accumulated credt, said processing means also operatively connected to receive coin availability status data and coin validity data, said processing means operatively connected to the controllable means to control such means and the acceptance or return thereby of each valid deposited coin, said processing means responsive to the production of coin analysis data representative of a valid deposited coin to determine the acceptability of such valid deposited coin for the particular vend operation in progress, such determination dependent upon the vend price, the accumulated credit, the coin validity data for the valid deposited coin, and the coin availability status data, said processing means effecting acceptance of such valid deposited coin by the controllable means and the accumulation of additional credit corresponding to the value of such valid deposited coin unless such additional credit accumulation would result in a credit accumulation in excess of the established vend price the correct amount of which excess credit acuumulation would be unavailable in coins available for payback.

20. The vending system of claim 19 wherein said processing means includes a programmed microprocessor.

21. The vending system of claim 20 wherein said microprocessor is programmed to (a) be responsive to the next production of coin analysis data representative of a valid deposited coin to continue to step (b), (b) determine whether or not such valid deposited coin will be accepted, such determination being dependent upon the vend price, the accumulated credit, the coin analysis data for the valid deposited coin, and the coin availability status data, and, (i) if such valid deposited coin is to be accepted, to continue to step (c), (ii) otherwise, to return to step (a), (c) effect acceptance of such valid deposited coin by the controllable means and accumulation of additional credit corresponding to the value of such valid deposited coin.

22. The vending system of claim 21 wherein said microprocessor is programmed in step (b) to determine to accept such valid deposited coin only if the additional credit accumulation that will be attributable to such coin, if accepted, will not result in a credit accumulation in excess of the established vend price the correct amount of which excess credit accumulation would be unavailable in coins available for payback.

23. A coin acceptance method for use in determining the acceptability of each valid coin deposited during a vend operation in a vending system wherein a vend price for such given vend operation is established prior to the deposit of coins or submission of credit with regard to such particular vend operation, the vending system including coin analysis means for analyzing deposited coins, such coin analysis means producing coin analysis data when a coin is deposited, coin availability status means for determining coins available for payback, such coin availability status means producing coin availability status data indicative of the status of coins available for payback, and means for accumulating credit when a deposited coin is accepted, said coin acceptance method comprising the steps, after a vend price has been established and coin availability status data is available, of (a) responding to the next production by the coin analysis means of coin analysis data representative of a valid deposited coin and continuing to step (b), (b) determining whether or not such valid deposited coin will be accepted, such determination being dependent upon the vend price, any credit previously accumulated during the vend operation, the coin analysis data for the validated deposited coin, and the coin availabiility status data, and, (i) if the additional credit accumulation that will be attributable to such coin, if accepted, will not result in a credit accumulation in excess of the established vend price the correct amount of which excess credit accumulation will be unavailable in coins available for payback, proceeding to step (c), (ii) otherwise, returning to step (a).

(c) accepting such valid deposited coin and accumulating the additional credit attributable thereto.

24. Coin acceptance means for a vending system wherein a vend price for a given vend operation is established prior to the deposit of coins or submission of credit with regard to such particular vend operation, which vending system includes coin validation means for detecting and validating deposited coins, controllable means for accepting and returning deposited coins, coin availability status means for determining coins available for payback, and vend control means for controlling a vend operation, the vend control means operable to accumulate credit upon the acceptance of a coin and to effect a vend when the amount of accumulated credit at least equals the established vend price, said coin acceptance means operatively connected to the coin validation means and to the coin availability status means and the vend control means, said coin acceptance means responsive to each detection of a validated coin to determine the acceptability thereof and to effect acceptance of such validated coin by the controllable means and the accumulation by the vend control means of credit corresponding to the value of such validated coin unless such acceptance and credit accumulation would result in a credit accumulation in excess of the established vend price the correct amount of which excess credit accumulation would be unavailable in coins available for payback, such determination of acceptability being dependent upon the vend price, the accumulated credit, the coin analysis data for the validated coin, and the coin availability status data.

* * * * *

UNITED STATES PATENT OFFICE

CERTIFICATE OF CORRECTION

Patent No. 4,763,769 Dated August 16, 1988

Inventor(s) Joseph L. Levasseur

It is certified that error appears in the above-identified patent and that said Letters Patent are hereby corrected as shown below:

Column 15, line 10, "25" should be --0.25--.

Column 15, line 53, "0.75" should be --≥.75--.

Column 16, line 27, "1.00" should be --<1.00--.

Column 18, line 12, "oy" should be --by--.

Column 25, line 20, "$.0" should be --$0.X0--.

Column 25, line 28, "$0.x0" should be --$0.X0--.

Column 25, line 32, "<$0.25" should be --<$.25--.

Column 25, line 32, "<$.25" should be --≥$.25--.

Column 25, line 49, "<0.X0" should be --$0.X0--.

Column 25, line 51, "<0.X0" should be --$0.X0--.

Column 25, line 64, "$0X0" should be --$0.X0--.

Column 27, line 38, "accumulate" should be --accumulated--.

Column 27, line 40, the first occurrence of the word "the" should be --be--.

UNITED STATES PATENT OFFICE

CERTIFICATE OF CORRECTION

Patent No. 4,763,769 Dated August 16, 1988

Inventor(s) Joseph L. Levasseur

It is certified that error appears in the above-identified patent and that said Letters Patent are hereby corrected as shown below:

Column 29, line 34, "creadit" should be --credit--.

Column 30, line 57, "to" should be --be--.

Column 31, line 38, "to" should be --be--.

Column 31, line 57, "credt" should be --credit--.

Signed and Sealed this

Tenth Day of January, 1989

*Attest:*

*Attesting Officer*

DONALD J. QUIGG

*Commissioner of Patents and Trademarks*

UNITED STATES PATENT OFFICE

CERTIFICATE OF CORRECTION

Patent No. 4,763,769 Dated August 16, 1988

Inventor(s) Levasseur

It is certified that error appears in the above-identified patent and that said Letters Patent is hereby corrected as shown below:

Column 32, in order to properly set forth the process steps set forth in lines 25-29, such lines should be rewritten as:

(ii) otherwise, to return to step (a),
(c) effect acceptance of such valid deposited coin by the controllable means and accumulation of additional credit corresponding to the value of such valid deposited coin.

Signed and Sealed this

Twenty-ninth Day of May, 1990

*Attest:*

HARRY F. MANBECK, JR.

*Attesting Officer*

*Commissioner of Patents and Trademarks*